US007633357B2

(12) United States Patent
Hangai et al.

(10) Patent No.: US 7,633,357 B2
(45) Date of Patent: Dec. 15, 2009

(54) SPST SWITCH, SPDT SWITCH AND MPMT SWITCH

(75) Inventors: Masatake Hangai, Tokyo (JP); Morishige Hieda, Tokyo (JP); Moriyasu Miyazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 448 days.

(21) Appl. No.: 10/586,748

(22) PCT Filed: Mar. 24, 2004

(86) PCT No.: PCT/JP2004/004015

§ 371 (c)(1),
(2), (4) Date: Jul. 21, 2006

(87) PCT Pub. No.: WO2005/093894

PCT Pub. Date: Oct. 6, 2005

(65) Prior Publication Data

US 2008/0238570 A1 Oct. 2, 2008

(51) Int. Cl.
*H01P 1/10* (2006.01)
*H03K 17/687* (2006.01)

(52) U.S. Cl. ..... 333/103; 333/262

(58) Field of Classification Search ..... 333/103, 333/101, 262, 104
See application file for complete search history.

(56) References Cited

U.S. PATENT DOCUMENTS 4,789,846 A * 12/1988 Matsunaga et al. ..... 333/104
5,485,130 A * 1/1996 Nakahara et al. ..... 333/104
6,137,377 A * 10/2000 Wallace et al. ..... 333/139
6,674,341 B2 * 1/2004 Hieda et al. ..... 333/164

FOREIGN PATENT DOCUMENTS

JP 5-55803 A 3/1993
JP 5-299995 A 11/1993
JP 8-213472 A 8/1996

OTHER PUBLICATIONS

Matsunaga et al., IEICE Trans. Electron., vol. E75-C, No. 2, Feb. 1992.
Tokumitsu et al., IEEE 1993 Microwave and Millimeter-Wave Monolithic Circuits Symposium Digest 93.1.
Götzfried et al., IEEE MTT-S Digest, 1996.

* cited by examiner

*Primary Examiner*—Dean O Takaoka
(74) *Attorney, Agent, or Firm*—Birch, Stewart, Kolasch & Birch, LLP

(57) ABSTRACT

A single pole single throw switch for controlling propagation of a high frequency signal between an input terminal (11*a*) and an output terminal (11*b*). First FET switches (14*a*, 14*b*) in which drains and sources of FETs (12*a*, 12*b*) are connected in parallel with inductors (13*a*, 13*b*) are connected in parallel. Each FET (12*a*, 12*b*) is switched between on state and off state by a voltage being applied to the gate thereof. At the frequency of the high frequency signal, each inductor (13*a*, 13*b*) connected with off capacitor of each FET (12*a*, 12*b*) resonates in parallel.

9 Claims, 16 Drawing Sheets

FIG.26

| Input terminal or output terminal | Output terminal or input terminal | FET39a | FET39b | FET39c | FET39d |
|---|---|---|---|---|---|
| 38a | 38b | ON | ON | OFF | OFF |
| | 38c | ON | OFF | ON | OFF |
| | 38d | ON | OFF | OFF | ON |
| 38b | 38c | OFF | ON | ON | OFF |
| | 38d | OFF | ON | OFF | ON |
| 38c | 38d | OFF | OFF | ON | ON |

SPST SWITCH, SPDT SWITCH AND MPMT SWITCH

TECHNICAL FIELD

The present invention relates to a single-pole single-throw (SPST) switch, a single-pole double-throw (SPDT) switch and a multiple-pole multiple-throw (MPMT) switch for controlling propagation of a high frequency signal.

BACKGROUND ART

FIG. 1 is a circuit diagram showing a conventional SPDT switch shown in "High-power microwave transmit-receive switch with series and shunt GaAs FETs", IEICE Trans. ELECTRON, February 1992.

The SPDT switch as shown in FIG. 1 has an input terminal 1*a*, output terminal 1*b*, output terminal 1*c*, FET (field-effect transistor) 2*a*, FET 2*b*, inductor 3*a*, inductor 3*b*, line 4 and ground 5. The FET 2*a* has its drain connected to the input terminal 1*a*, and its source connected to the output terminal 1*c*. The inductor 3*a* has its first terminal connected to the input terminal 1*a*, and its second terminal connected to the output terminal 1*c*. The line 4 has its first terminal connected to the input terminal 1*a*, and its second terminal connected to the output terminal 1*b*. The FET 2*b* has its drain connected to the output terminal 1*b*, and its source connected to the ground 5. The inductor 3*b* has its first terminal connected to the output terminal 1*b*, and its second terminal connected to the ground 5.

Next the operation will be described.

In FIG. 1, the FET 2*a* and FET 2*b* operate as switches for switching between the ON state and OFF state in response to a voltage applied to their gates. When a gate voltage with the same potential as the drain voltage and source voltage is applied to the gate of the FET 2*a*, the FET 2*a* is brought into the ON state and exhibits a resistance property. On the other hand, when a voltage less than the pinch-off voltage is applied to the gate of the FET 2*a*, the FET 2*a* is brought into the OFF state and exhibits a capacitance property. The FET 2*b* operates in the same manner.

FIG. 2 is an equivalent circuit diagram when the FET 2*a* and FET 2*b* in FIG. 1 are brought into the OFF state. As shown in FIG. 2, when the FET 2*a* is brought into the OFF state, a state arises in which a parallel connection of an OFF capacitance 9 and an OFF resistance 10 is connected in series with a parasitic inductor 8 between the drain or source 6*a* and the source or drain 6*b* of the FET 2*a*. The same state arises when the FET 2*b* is brought into the OFF state.

FIG. 3 is an equivalent circuit diagram when the FET 2*a* and FET 2*b* in FIG. 1 are brought into an ON state. As shown in FIG. 3, when the FET 2*a* is brought into the ON state, a state arises in which the ON resistance 7 and parasitic inductor 8 are connected in series between the drain or source 6*a* and the source or drain 6*b* of the FET 2*a*. The same state arises when the FET 2*b* is brought into the ON state.

In FIG. 1, consider the case where the FET 2*a* and FET 2*b* are brought into the OFF state, that is, when the equivalent circuit diagram of the FET 2*a* and FET 2*b* is FIG. 2. At the frequency f1 used by the SPDT switch, when the reactance component of the parasitic inductor 8 is small enough as compared with the reactance component of the OFF capacitance 9, and the OFF resistance 10 is sufficiently large, and when the relationship holds of f1=1/√(capacitance of OFF capacitance 9 of FET 2*a*)×(inductance of inductor 3*a*)=1/√(capacitance of OFF capacitance 9 of FET 2*b*)×(inductance of inductor 3*b*), the impedance of the output terminal 1*b* seen from the input terminal 1*a* becomes low, and the impedance of the output terminal 1*c* seen from the input terminal 1*a* becomes high. In this case, the high frequency signal input through the input terminal 1*a* is fed to the output terminal 1*b*.

In addition, consider the case where the FET 2*a* and FET 2*b* are brought into the ON state in FIG. 1, that is, when the equivalent circuit diagram of the FET 2*a* and FET 2*b* is FIG. 3. In this case, the impedance of the output terminal 1*b* seen from the input terminal 1*a* becomes high, and the impedance of the output terminal 1*c* seen from the input terminal 1*a* becomes low. Thus, the high frequency signal input through the input terminal 1*a* is fed to the output terminal 1*c*.

With the foregoing configuration, the conventional SPDT switch has the following problem. When the gate width of the FET 2*a* and FET 2*b* is increased to achieve high withstanding power, the reactance component of the parasitic inductor 8 comes to be not negligible as compared with the reactance component of the OFF capacitance 9, and the OFF resistance 10 becomes small. Accordingly, when the FET 2*a* and FET 2*b* are brought into the OFF state, the propagation loss of the high frequency signal propagating from the input terminal 1*a* to the output terminal 1*b* increases, which presents a problem of reducing the isolation of the high frequency signal from the input terminal 1*a* to the output terminal 1*c*.

Although the conventional technique is described by way of example of the SPDT switch, an SPST switch or MPMT switch has the same problem.

The present invention is implemented to solve the foregoing problem. Therefore it is an object of the present invention to provide an SPST switch, SPDT switch and MPMT switch having characteristics of being able to achieve high withstanding power, to reduce propagation loss of the high frequency signal, and to prevent the reduction in the isolation.

DISCLOSURE OF THE INVENTION

According to one aspect of the present invention, there is provided an SPST (single-pole single-throw) switch for controlling propagation of a high frequency signal between an input terminal and an output terminal, the SPST switch comprising: a plurality of first field-effect transistor switches connected in parallel, each of which includes a field-effect transistor having its drain and source connected in parallel with an inductor, wherein each of the field-effect transistors has its ON state and OFF state changed by a voltage applied to a gate of each of the field-effect transistors, and each of the field-effect transistors has its OFF capacitance cause parallel resonance with the inductor connected at a frequency of the high frequency signal.

According to the present invention, an advantage is obtained of being able to achieve high withstanding power, and to reduce the propagation loss of the high frequency signal from the input terminal to the output terminal, and to prevent reduction in the isolation of the high frequency signal from the input terminal to the output terminal.

BRIEF DESCRIPTION OF THE DRAWINGS

FIG. 26 is a table illustrating the operation of the MPMT switch of FIG. 25.

BEST MODE FOR CARRYING OUT THE INVENTION

The best mode for carrying out the invention will now be described with reference to the accompanying drawings to explain the present invention in more detail.

Embodiment 1

Figure 1:
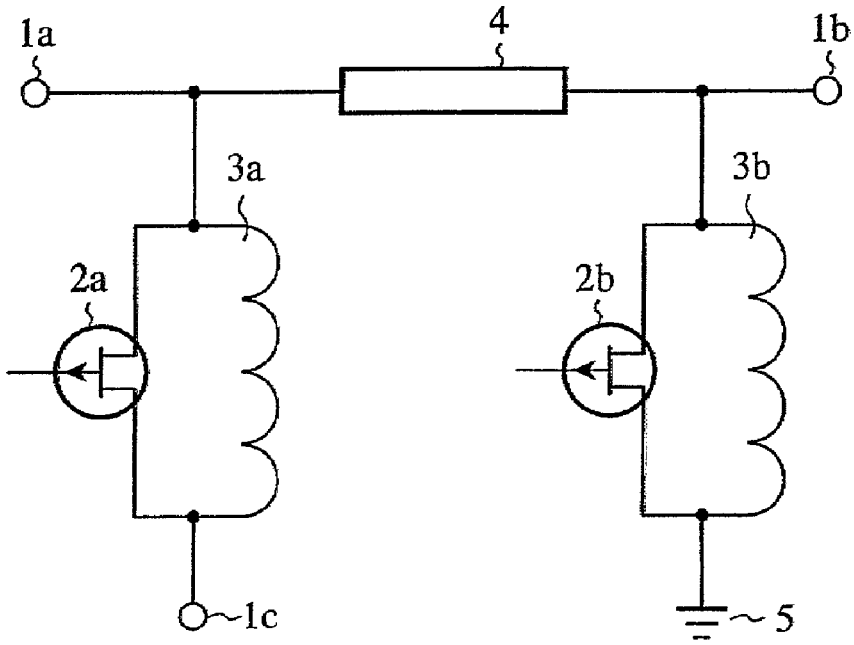
RELATED ART FIG.1
FIG. 1 is a circuit diagram showing a conventional SPDT switch.
Figure 2:
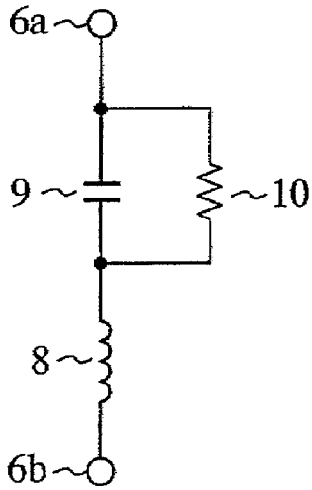
RELATED ART FIG.2
FIG. 2 is an equivalent circuit diagram when field-effect transistors in FIG. 1 are brought into the OFF state.
Figure 3:
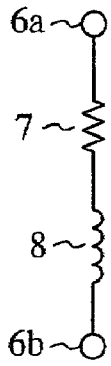
RELATED ART FIG.3
FIG. 3 is an equivalent circuit diagram when the field-effect transistors in FIG. 1 are brought into the ON state.
Figure 4:
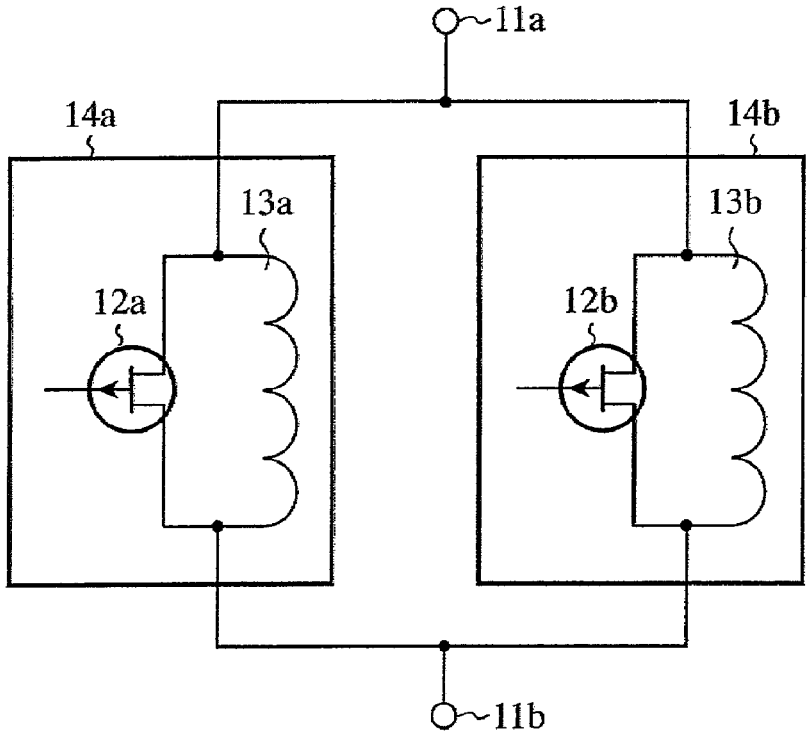
FIG. 4 is a circuit diagram showing a configuration of an SPST switch of an embodiment 1 in accordance with the present invention.

FIG. 4 is a circuit diagram showing a configuration of an SPST switch of an embodiment 1 in accordance with the present invention. The SPST switch shown in FIG. 4 has an input terminal 11*a*, output terminal 11*b*, FET (field-effect transistor) 12*a*, FET 12*b*, inductor 13*a* and inductor 13*b*. The parallel connection of the FET 12*a* and inductor 13*a* constitutes a first FET switch 14*a*, and the parallel connection of the FET 12*b* and inductor 13*b* constitutes a first FET switch 14*b*. The FET switches 14*a* and 14*b* have their first terminals connected to the input terminal 11*a*, and their second terminals connected to the output terminal 11*b*. Thus, the first FET switch 14*a* is connected in parallel with the first FET switch 14*b* in the present embodiment 1.

Connecting the two FETs 12*a* and 12*b* in parallel can halve their individual gate width to achieve the same withstanding power. Halving the individual gate width can make the reactance components of the parasitic inductors of the FETs 12*a* and 12*b* small enough as compared with the reactance component of the OFF capacitance at the frequency f used by the SPST switch, and make the OFF resistance large enough.

Here, the drains of the FET 12*a* and FET 12*b* can be connected to the input terminal 11*a* or output terminal 11*b*, and the sources of the FET 12*a* and FET 12*b* can be connected to the output terminal 11*b* or input terminal 11*a*.

Next the operation will be described.

In FIG. 4, the FET 2*a* and FET 2*b* operate as switches for switching between the ON state and OFF state by the voltages applied to the gates.

Figure 5:
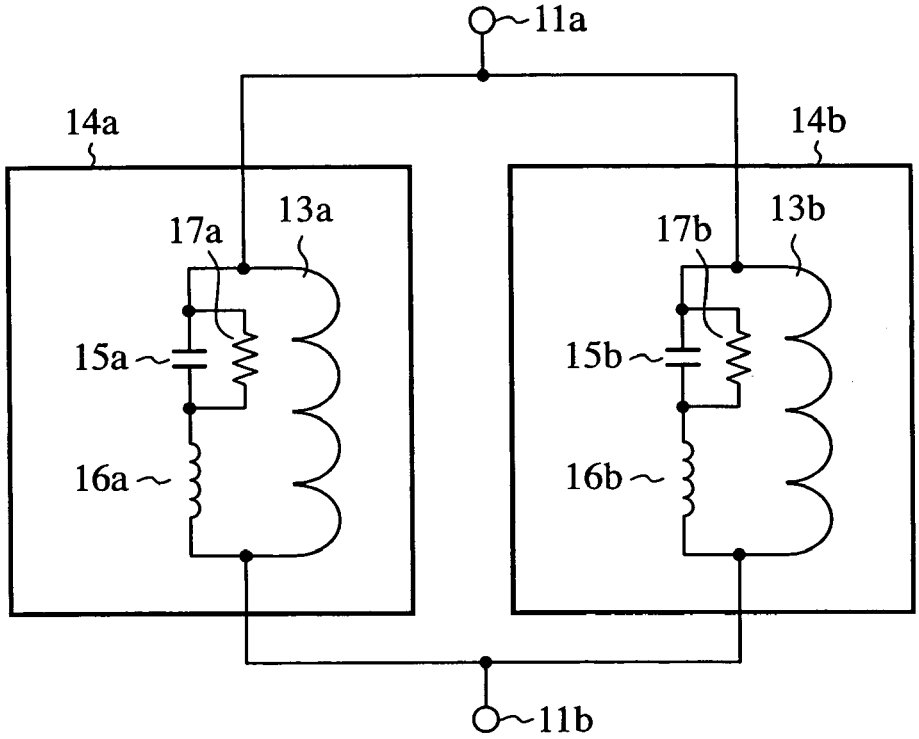
FIG. 5 is an equivalent circuit diagram when field-effect transistors in FIG. 4 are brought into the OFF state.

FIG. 5 is an equivalent circuit diagram when the FET 12*a* and FET 12*b* in FIG. 4 are brought into the OFF state. As shown in FIG. 5, when the FET 12*a* is brought into the OFF state, a state arises in which the OFF capacitance 15*a* and OFF resistance 17*a* which are connected in parallel are connected in series with the parasitic inductor 16*a*, and when the FET 12*b* is brought into the OFF state, a state arises in which the OFF capacitance 15*b* and OFF resistance 17*b* which are connected in parallel are connected in series with the parasitic inductor 16*b*.

At the frequency f used by the SPST switch, the reactance components of the parasitic inductors 16*a* and 16*b* are small enough as compared with the reactance components of the OFF capacitances 15*a* and 15*b*, and the OFF resistances 17*a* and 17*b* are large enough. Thus, when $f=1/\sqrt{(\text{capacitance of OFF capacitance } 15a)\times(\text{inductance of inductor } 13a)}=1/\sqrt{(\text{capacitance of OFF capacitance } 15b)\times(\text{inductance of inductor } 13b)}$, that is, when the inductor 13*a* that will cause parallel resonance with the OFF capacitance 15*a* at the used frequency f is connected, and when the inductor 13*b* that will cause parallel resonance with the OFF capacitance 15*b* at the used frequency f is connected, the impedance of the output terminal 11*b* seen from the input terminal 11*a* becomes high. In this case, the high frequency signal input through the input terminal 11*a* is not fed to the output terminal 11*b*, and the isolation does not reduce of the high frequency signal from the input terminal 11*a* to the output terminal 11*b*.

Figure 6:
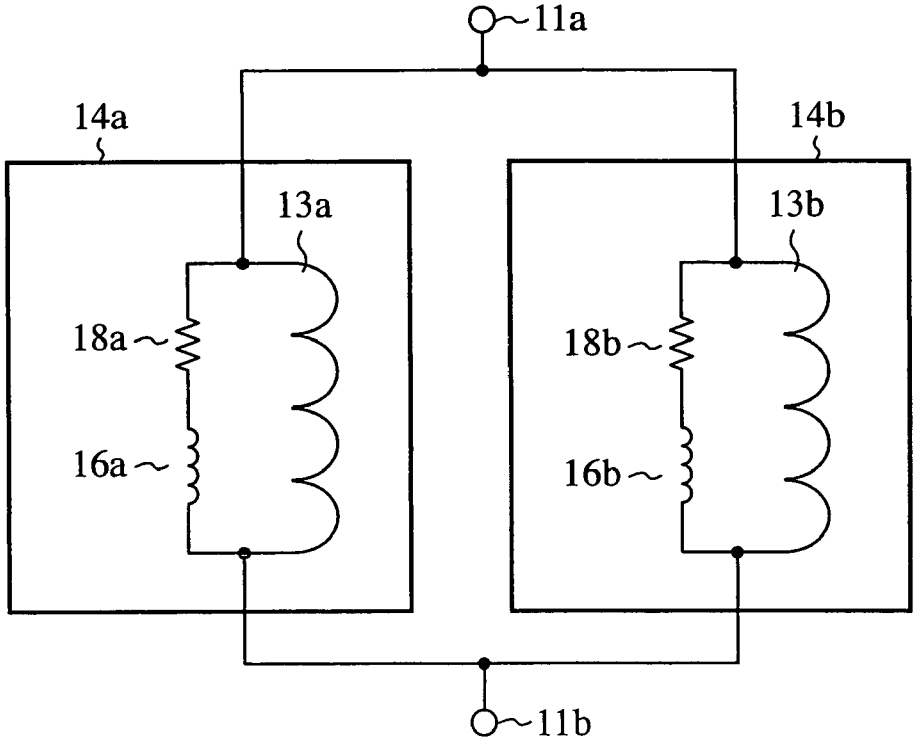
FIG. 6 is an equivalent circuit diagram when the field-effect transistors in FIG. 4 are brought into the ON state.

FIG. 6 is an equivalent circuit diagram when the FET 12*a* and FET 12*b* in FIG. 4 are brought into the ON state. As shown in FIG. 6, when the FET 12*a* is brought into the ON state, a state arises in which the ON resistance 18*a* and parasitic inductor 16*a* are connected in series, and when the FET 12*b* is brought into the ON state, a state arises in which the ON resistance 18*b* and parasitic inductor 16*b* are connected in series.

In this case, since the first FET switches 14*a* and 14*b* are connected in parallel, the impedance of the output terminal 11*b* seen from the input terminal 11*a* becomes low. Thus, the high frequency signal input through the input terminal 11*a* is fed to the output terminal 11*b*, and the propagation loss of the high frequency signal from the input terminal 11*a* to the output terminal 11*b* can be reduced.

In the present embodiment 1, although the high frequency signal is controlled in such a manner that it is input through the input terminal 11*a* and is fed to the output terminal 11*b*, this is not essential. A configuration is also possible in which the high frequency signal is controlled in such a manner that it is input through the output terminal 11*b* and is fed to the input terminal 11*a*.

In addition, although the two first FET switches 14*a* and 14*b* are connected in parallel to halve the gate width of each of the FETs 12*a* and 12*b* in the present embodiment 1, this is not essential. A configuration is also possible in which two or more first FET switches are connected in parallel to narrow the gate width in accordance with the number of the FETs.

As described above, the present embodiment 1 can halve the gate width for achieving the same withstanding power by connecting the first FET switches 14*a* and 14*b* in parallel, and can make, at the used frequency f of the SPST switch, the reactance components of the parasitic inductors 16*a* and 16*b* of the FETs 12*a* and 12*b* small enough as compared with the reactance components of the OFF capacitances 15*a* and 15*b*, and make the OFF resistances 17*a* and 17*b* large enough. Thus, connecting the inductors 13*a* and 13*b* that will cause the parallel resonance with the OFF capacitances 15*a* and 15*b* offers an advantage of being able to achieve the high withstanding voltage and prevent the reduction in the isolation of the high frequency signal from the input terminal 11*a* to the output terminal 11*b*, and to reduce the propagation loss of the high frequency signal from the input terminal 11*a* to the output terminal 11*b*.

Embodiment 2

Figure 7:
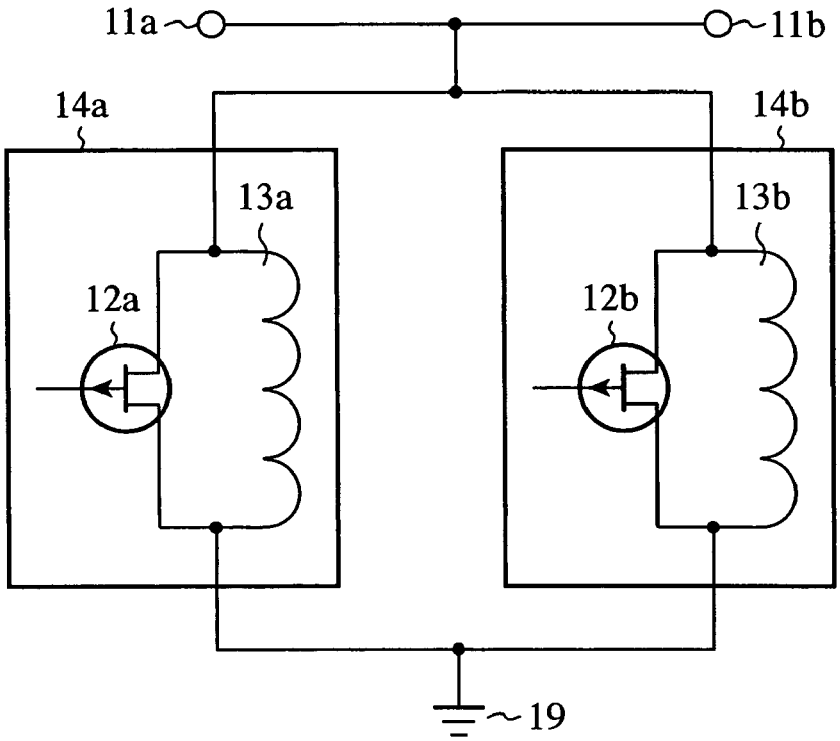
FIG. 7 is a circuit diagram showing a configuration of an SPST switch of an embodiment 2 in accordance with the present invention.

FIG. 7 is a circuit diagram showing a configuration of an SPST switch of an embodiment 2 in accordance with the present invention. As the SPST switch of the embodiment 1 shown in FIG. 4, the SPST switch shown in FIG. 7 has an input terminal 11*a*, output terminal 11*b*, FET 12*a*, FET 12*b*, inductor 13*a* and inductor 13*b*. The parallel connection of the FET 12*a* and inductor 13*a* constitutes a first FET switch 14*a*, and the parallel connection of the FET 12*b* and inductor 13*b* constitutes a first FET switch 14*b*. The embodiment 2, however, differs from the embodiment 1 in that the input terminal 11*a* and the output terminal 11*b* are connected directly, and in that the first FET switch 14*a* and first FET switch 14*b* have their first terminals connected to the input terminal 11*a* and output terminal 11*b*, and their second terminals connected to the ground 19. Thus, in the present embodiment 2, the first FET switch 14*a* is connected in parallel with the first FET switch 14*b*.

Connecting the two FETs 12*a* and 12*b* in parallel can halve their individual gate width to achieve the same withstanding power. Halving the individual gate width can make the reactance components of the parasitic inductors of the FETs 12*a* and 12*b* small enough as compared with the reactance component of the OFF capacitance at the frequency f used by the SPST switch, and make the OFF resistance large enough.

Here, the drains of the FET 12*a* and FET 12*b* can be connected to the input terminal 11*a* or the ground 19, and the sources of the FET 12*a* and FET 12*b* can be connected to the ground 19 or input terminal 11*a*.

Next the operation will be described.

In FIG. 7, the FET 2*a* and FET 2*b* operate as switches for switching between the ON state and OFF state by the voltages applied to the gates.

Figure 8:
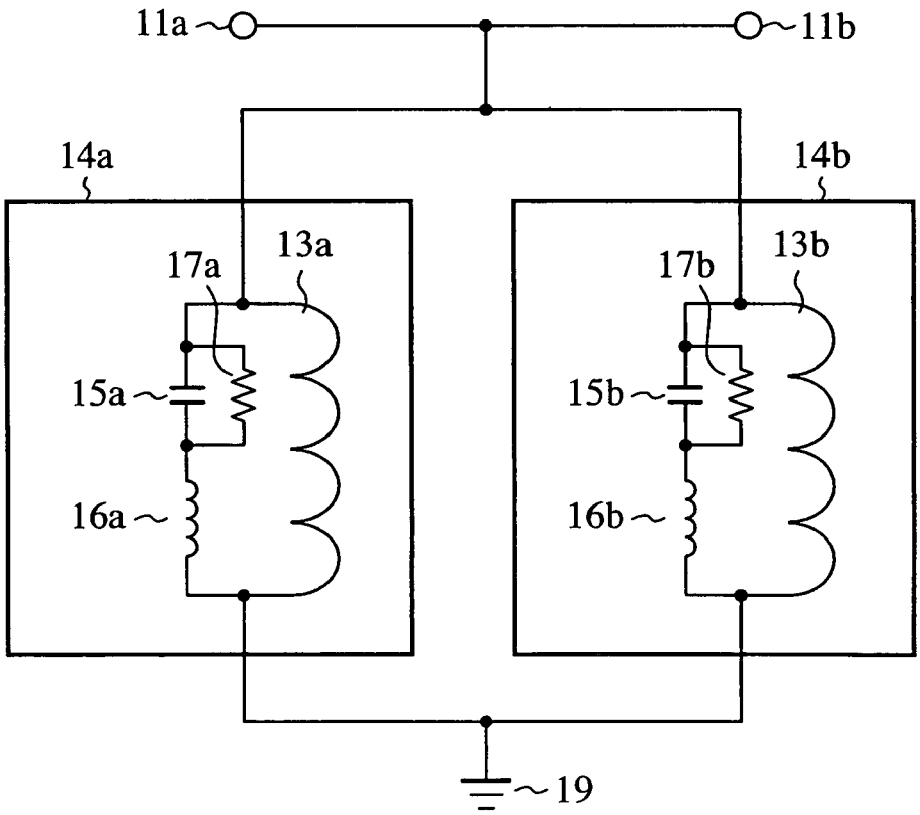
FIG. 8 is an equivalent circuit diagram when field-effect transistors in FIG. 7 are brought into the OFF state.

FIG. 8 is an equivalent circuit diagram when the FET 12*a* and FET 12*b* in FIG. 7 are brought into the OFF state. As shown in FIG. 8, when the FET 12*a* is brought into the OFF state, a state arises in which the OFF capacitance 15*a* and OFF resistance 17*a* which are connected in parallel are connected in series with the parasitic inductor 16*a*, and when the FET 12*b* is brought into the OFF state, a state arises in which the OFF capacitance 15*b* and OFF resistance 17*b* which are connected in parallel are connected in series with the parasitic inductor 16*b*.

In this case, at the frequency f used by the SPST switch, the reactance components of the parasitic inductors 16*a* and 16*b* are small enough as compared with the reactance components of the OFF capacitances 15*a* and 15*b*, and the OFF resistances 17*a* and 17*b* are large enough. Thus, when $f=1/\sqrt{(\text{capacitance of OFF capacitance } 15a)\times(\text{inductance of inductor } 13a)}=1/\sqrt{(\text{capacitance of OFF capacitance } 15b)\times(\text{inductance of inductor } 13b)}$, that is, when the inductor 13*a* that will cause parallel resonance with the OFF capacitance 15*a* at the used frequency f is connected, and when the inductor 13*b* that will cause parallel resonance with the OFF capacitance 15*b* at the used frequency f is connected, the impedance of the ground 19 seen from the input terminal 11*a* becomes high. As a result, the high frequency signal input through the input terminal 11*a* is fed to the output terminal 11*b*, and the propagation loss of the high frequency signal can be reduced.

Figure 9:
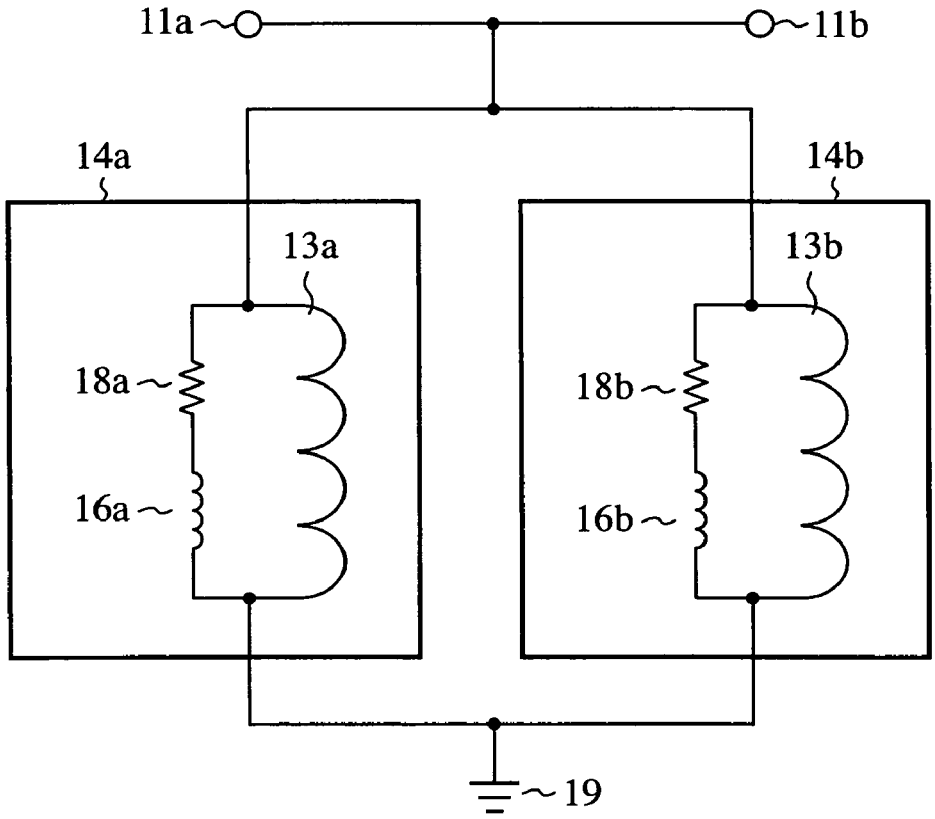
FIG. 9 is an equivalent circuit diagram when the field-effect transistors in FIG. 7 are brought into the ON state.

FIG. 9 is an equivalent circuit diagram when the FET 12*a* and FET 12*b* in FIG. 7 are brought into the ON state. As shown in FIG. 9, when the FET 12*a* is brought into the ON state, a state arises in which the ON resistance 18*a* and parasitic inductor 16*a* are connected in series, and when the FET 12*b* is brought into the ON state, a state arises in which the ON resistance 18*b* and parasitic inductor 16*b* are connected in series.

In this case, since the first FET switches 14*a* and 14*b* are connected in parallel, the impedance of the ground 19 seen from the input terminal 11*a* becomes low. Thus, the high frequency signal input through the input terminal 11*a* is propagated to the ground 19 without being fed to the output terminal 11*b*, and the isolation is not reduced of the high frequency signal from the input terminal 11*a* to the output terminal 11*b*.

In the present embodiment 2, although the high frequency signal is controlled in such a manner that it is input through the input terminal 11*a* and is fed to the output terminal 11*b*, this is not essential. A configuration is also possible in which the high frequency signal is controlled in such a manner that it is input through the output terminal 11*b* and is fed to the input terminal 11*a*.

In addition, although the two first FET switches 14*a* and 14*b* are connected in parallel to halve the gate width of each of the FETs 12*a* and 12*b* in the present embodiment 2, this is not essential. A configuration is also possible in which two or more first FET switches are connected in parallel to narrow the gate width in accordance with the number of the FETs.

As described above, the present embodiment 2 can halve the gate width for achieving the same withstanding power by connecting the first FET switches 14*a* and 14*b* in parallel, and can make, at the used frequency f of the SPST switch, the reactance components of the parasitic inductors 16*a* and 16*b* of the FETs 12*a* and 12*b* small enough as compared with the reactance components of the OFF capacitances 15*a* and 15*b*, and make the OFF resistances 17*a* and 17*b* large enough. Thus, connecting the inductors 13*a* and 13*b* that will cause the parallel resonance with the OFF capacitances 15*a* and 15*b* offers an advantage of being able to achieve the high withstanding voltage and to reduce the propagation loss of the high frequency signal from the input terminal 11*a* to the output terminal 11*b*, and to prevent the reduction in the isolation of the high frequency signal from the input terminal 11*a* to the output terminal 11*b*.

Embodiment 3

Figure 10:
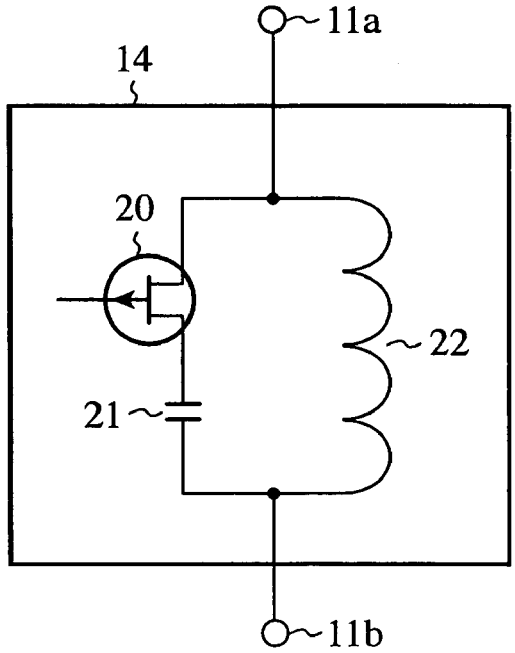
FIG. 10 is a circuit diagram showing a configuration of an SPST switch of an embodiment 3 in accordance with the present invention.

FIG. 10 is a circuit diagram showing a configuration of an SPST switch of an embodiment 3 in accordance with the present invention. The SPST switch shown in FIG. 10 has an input terminal 11*a*, output terminal 11*b*, FET 20, capacitor 21 and inductor 22. A second FET switch 14, which consists of a series connection of the FET 20 and capacitor 21, and the inductor 22 connected in parallel with the series connection, has its first terminal connected to the input terminal 11*a*, and has its second terminal connected to the output terminal 11*b*.

Here, the drain of the FET 20 can be connected to the input terminal 11*a* or capacitor 21, and the source of the FET 20 can be connected to the capacitor 21 or input terminal 11*a*.

Next the operation will be described.

In FIG. 10, the FET 20 operates as a switch for switching between the ON state and OFF state by the voltage applied to the gate.

Figure 11:
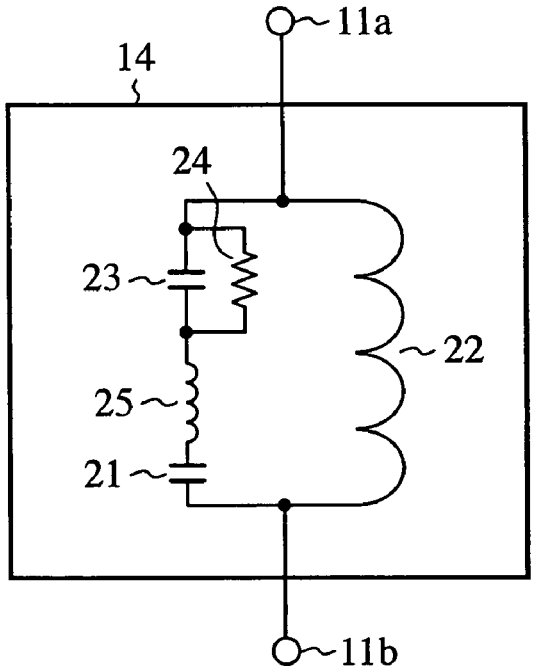
FIG. 11 is an equivalent circuit diagram when the field-effect transistor in FIG. 10 is brought into the OFF state.

FIG. 11 is an equivalent circuit diagram when the FET 20 in FIG. 10 is brought into the OFF state. As shown in FIG. 11, when the FET 20 is brought into the OFF state, a state arises in which the OFF capacitance 23 and OFF resistance 24 which are connected in parallel are connected in series with the parasitic inductor 25.

When the relationship holds of f2=1/2π√(inductance of parasitic inductor 25)×(capacitance of capacitor 21) at the used frequency f2 of the SPST switch in the present embodiment 3, that is, when the capacitor 21 that will cause series resonance with the parasitic inductor 25 is connected, the parasitic inductor 25 that hinders the parallel resonance of the OFF capacitance 23 and inductor 22 is electrically canceled out. In addition, when the relationship holds of f2=1/√(capacitance of OFF capacitance 23)×(inductance of inductor 22) at the used frequency f2 of the SPST switch, that is, when the inductor 22 that will cause parallel resonance with the OFF capacitance 23, the impedance of the output terminal 11*b* seen from the input terminal 11*a* becomes high. In this case, the high frequency signal input through the input terminal 11*a* is not fed to the output terminal 11*b*. Thus, the isolation of the high frequency signal from the input terminal 11*a* to the output terminal 11*b* is not reduced.

Figure 12:
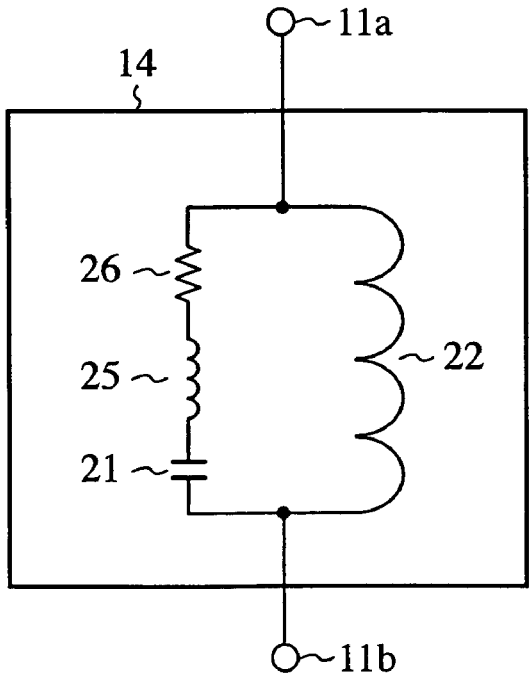
FIG. 12 is an equivalent circuit diagram when the field-effect transistor in FIG. 10 is brought into the ON state.

FIG. 12 is an equivalent circuit diagram when the FET 20 in FIG. 10 is brought into the ON state. As shown in FIG. 12, when the FET 20 is brought into the ON state, a state arises in which the ON resistance 26 and the parasitic inductor 25 are connected in series.

When the relationship holds of f2=1/2π√(inductance of parasitic inductor 25)×(capacitance of capacitor 21), that is, when the capacitor 21 that will cause series resonance with the parasitic inductor 25 is connected, the impedance of the output terminal 11*b* seen from the input terminal 11*a* becomes low. In this case, the high frequency signal input through the input terminal 11*a* is fed to the output terminal 11*b*, and the propagation loss of the high frequency signal can be reduced.

Here, the inductance of the parasitic inductor 25 in the OFF state of the FET 20 as shown in FIG. 11 is equal to the inductance of parasitic inductor 25 in the ON state of the FET 20 as shown in FIG. 12. In addition, the values of the capacitance of capacitor 21 that will cause the series resonance with the parasitic inductor 25 in the OFF state and in the ON state of the FET 20 are equal.

In the present embodiment 3, although the high frequency signal is controlled in such a manner that it is input through the input terminal 11*a* and is fed to the output terminal 11*b*, this is not essential. A configuration is also possible in which the high frequency signal is controlled in such a manner that it is input through the output terminal 11*b* and is fed to the input terminal 11*a*.

As described above, even when the gate width of the FET 20 is increased to provide the SPST switch with the high withstanding power, the present embodiment 3 offers an advantage of being able to prevent the reduction in the isolation of the high frequency signal from the input terminal 11*a* to the output terminal 11*b*, and to reduce the propagation loss of the high frequency signal from the input terminal 11*a* to the output terminal 11*b* by connecting the capacitor 21 that will cause the series resonance with the parasitic inductor 25 of the FET 20 at the used frequency f2 of the SPST switch, and by connecting the inductor 22 that will cause the parallel resonance with the capacitance of the OFF capacitance 23 of the FET 20 at the used frequency.

Embodiment 4

Figure 13:
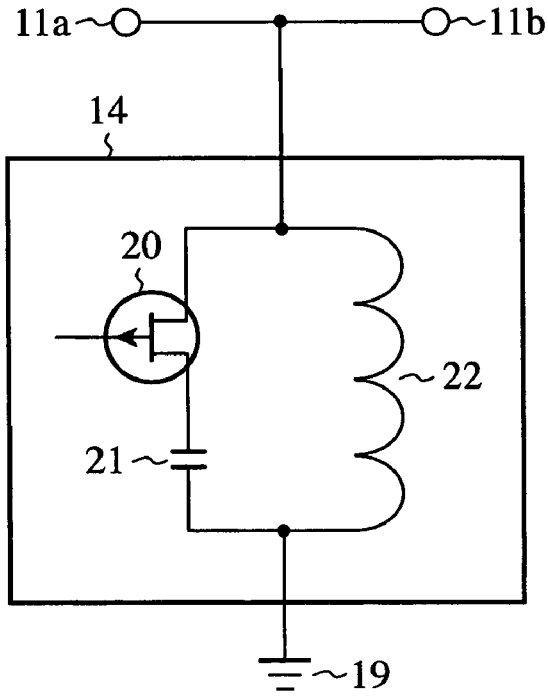
FIG. 13 is a circuit diagram showing a configuration of an SPST switch of an embodiment 4 in accordance with the present invention.

FIG. 13 is a circuit diagram showing a configuration of an SPST switch of an embodiment 4 in accordance with the present invention. As the SPST switch of the embodiment 3 as shown in FIG. 10, the SPST switch shown in FIG. 13 has an input terminal 11*a*, output terminal 11*b*, FET 20, capacitor 21 and inductor 22. The embodiment 4, however, differs from the embodiment 3 in that the input terminal 11*a* and the output terminal 11*b* are connected directly, and in that the second FET switch 14, which consists of a series connection of the FET 20 and capacitor 21 and the inductor 22 connected in parallel with the series connection, has its first terminal connected to the input terminal 11*a* and output terminal 11*b*, and has its second terminal connected to the ground 19.

Here, the drain of the FET 20 can be connected to the input terminal 11*a* or capacitor 21, and the source of the FET 20 can be connected to the capacitor 21 or input terminal 11*a*.

Next the operation will be described.

In FIG. 13, the FET 20 operates as a switch for switching between the ON state and OFF state by the voltage applied to the gate.

Figure 14:
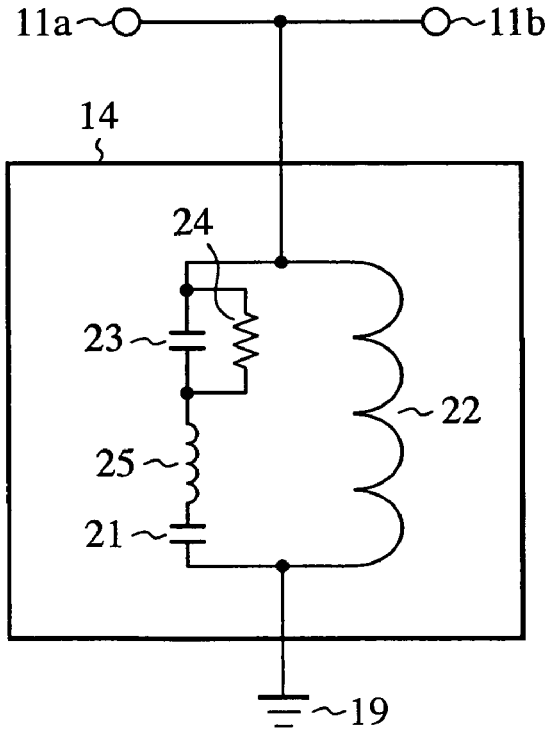
FIG. 14 is an equivalent circuit diagram when the field-effect transistor in FIG. 13 is brought into the OFF state.

FIG. 14 is an equivalent circuit diagram when the FET 20 in FIG. 13 is brought into the OFF state. As shown in FIG. 14, when the FET 20 is brought into the OFF state, a state arises in which the OFF capacitance 23 and OFF resistance 24 which are connected in parallel are connected in series with the parasitic inductor 25.

When the relationship holds of f3=1/2π√(inductance of parasitic inductor 25)×(capacitance of capacitor 21) at the used frequency f3 of the SPST switch in the present embodiment, that is, when the capacitor 21 that will cause series resonance with the parasitic inductor 25 of the FET 20 is connected, the parasitic inductor 25 that hinders the parallel resonance of the OFF capacitance 23 and inductor 22 is electrically canceled out. In addition, when the relationship holds of f3=1/√(capacitance of OFF capacitance 23)×(inductance of inductor 22) at the used frequency f3 of the SPST switch, that is, when the inductor 22 that will cause parallel resonance with the OFF capacitance 23 of the FET 20 is connected, the impedance of the ground 19 seen from the input terminal 11*a* becomes high. In this case, the high frequency signal input through the input terminal 11*a* is fed to the output terminal 11*b*, and the propagation loss of the high frequency signal can be reduced.

Figure 15:
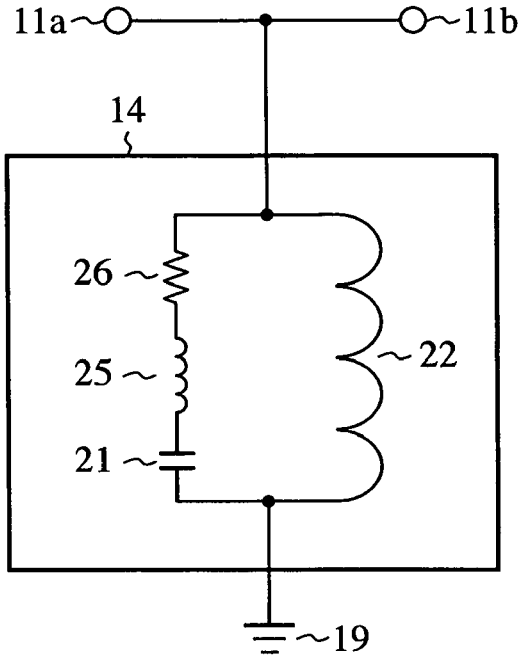
FIG. 15 is an equivalent circuit diagram when the field-effect transistor in FIG. 13 is brought into the ON state.

FIG. 15 is an equivalent circuit diagram when the FET 20 in FIG. 13 is brought into the ON state. As shown in FIG. 15, when the FET 20 is brought into the ON state, a state arises in which the ON resistance 26 and the parasitic inductor 25 are connected in series.

When the relationship holds of f3=1/2π√(inductance of parasitic inductor 25)×(capacitance of capacitor 21), that is, when the capacitor 21 that will cause series resonance with the parasitic inductor 25 of the FET 20 is connected, the impedance of the ground 19 seen from the input terminal 11*a* becomes low. In this case, the high frequency signal input through the input terminal 11*a* propagates to the ground 19 without being fed to the output terminal 11*b*, and the isolation of the high frequency signal from the input terminal 11*a* to the output terminal 11*b* is not reduced.

Here, the inductance of the parasitic inductor 25 in the OFF state of the FET 20 as shown in FIG. 14 is equal to the inductance of parasitic inductor 25 in the ON state of the FET 20 as shown in FIG. 15. In addition, the values of the capacitance of capacitor 21 that will cause the series resonance with the parasitic inductor 25 in the OFF state and in the ON state of the FET 20 are equal.

In the present embodiment 4, although the high frequency signal is controlled in such a manner that it is input through the input terminal 11*a* and is fed to the output terminal 11*b*, this is not essential. A configuration is also possible in which the high frequency signal is controlled in such a manner that it is input through the output terminal 11*b* and is fed to the input terminal 11*a*.

As described above, even when the gate width of the FET 20 is increased to provide the SPST switch with the high withstanding power, the present embodiment 4 offers an advantage of being able to reduce the propagation loss of the high frequency signal from the input terminal 11*a* to the output terminal 11*b*, and to prevent the reduction in the isolation of the high frequency signal from the input terminal 11*a* to the output terminal 11*b* by connecting the capacitor 21 that will cause the series resonance with the parasitic inductor 25 at the used frequency f3 of the SPST switch, and by connecting the inductor 22 that will cause the parallel resonance with the OFF capacitance 23 at the used frequency.

Embodiment 5

Figure 16:
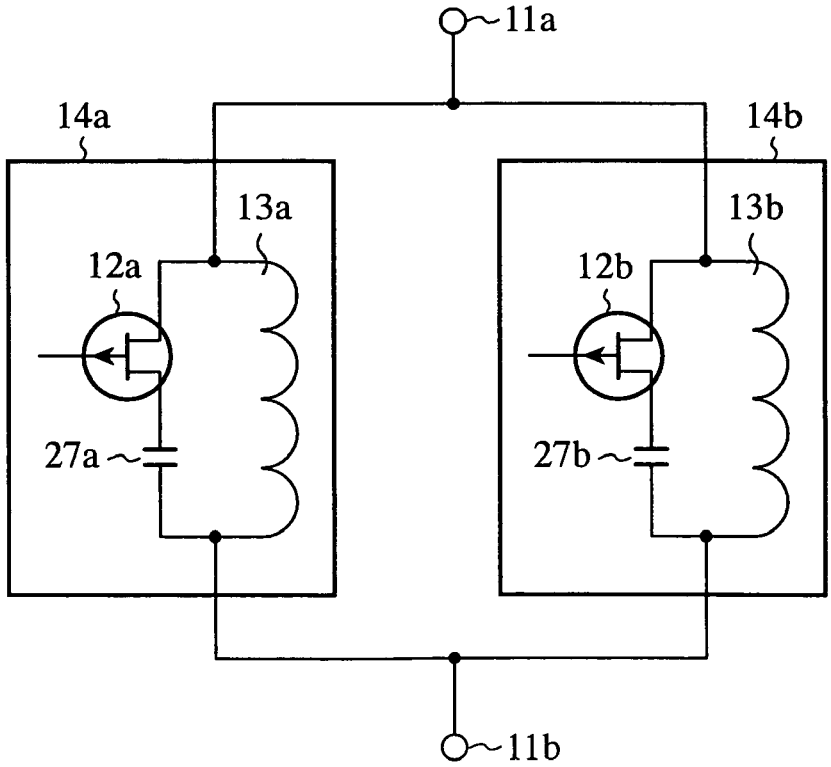
FIG. 16 is a circuit diagram showing a configuration of an SPST switch of an embodiment 5 in accordance with the present invention.

FIG. 16 is a circuit diagram showing a configuration of an SPST switch of an embodiment 5 in accordance with the present invention. The SPST switch as shown in FIG. 16, which employs parallel connection of the two second FET switches 14 of the embodiment 3 as shown in FIG. 10, has an input terminal 11*a*, output terminal 11*b*, FET 12*a*, FET 12*b*, inductor 13*a*, inductor 13*b*, capacitor 27*a*, and capacitor 27*b*. The second FET switch 14*a*, in which the serial connection of the FET 12*a* and capacitor 27*a* is connected in parallel with the inductor 13*a*, and the second FET switch 14*b*, in which the serial connection of the FET 12*b* and capacitor 27*b* is connected in parallel with the inductor 13*b*, have their first terminals connected to the input terminal 11*a* and their second terminals connected to the output terminal 11*b*.

Next the operation will be described.

In FIG. 16, the FET 2*a* and FET 2*b* operate as switches for switching between the ON state and OFF state by the voltages applied to the gates.

Figure 17:
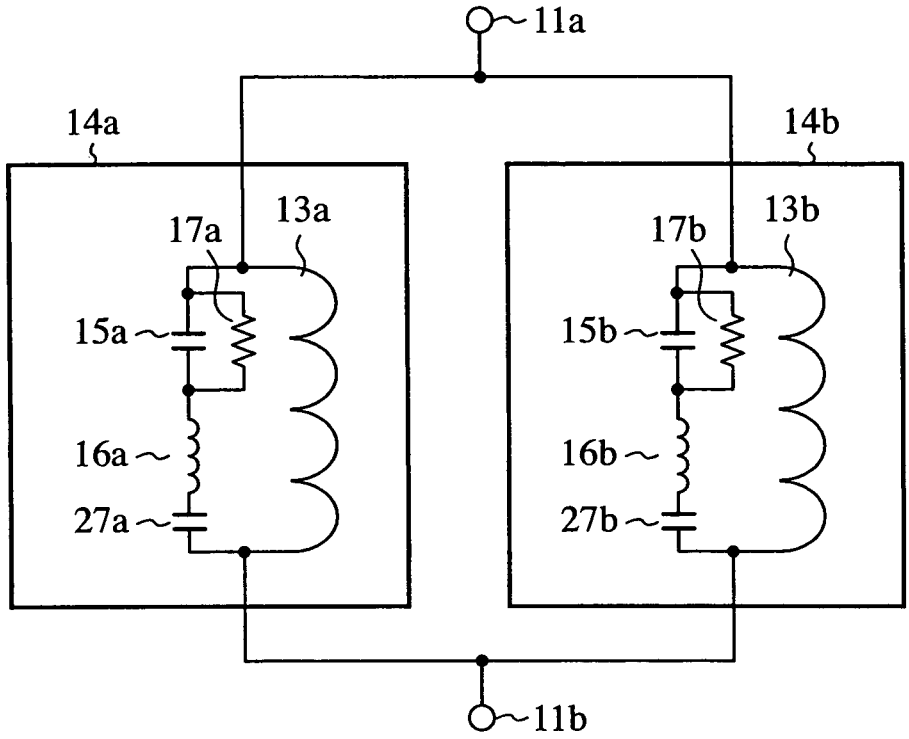
FIG. 17 is an equivalent circuit diagram when field-effect transistors in FIG. 16 are brought into the OFF state.

FIG. 17 is an equivalent circuit diagram when the FET 12*a* and FET 12*b* in FIG. 16 are brought into the OFF state. As shown in FIG. 17, when the FET 12*a* is brought into the OFF state, a state arises in which the OFF capacitance 15*a* and OFF resistance 17*a* which are connected in parallel are connected in series with the parasitic inductor 16*a*, and when the FET 12*b* is brought into the OFF state, a state arises in which the OFF capacitance 15*b* and OFF resistance 17*b* which are connected in parallel are connected in series with the parasitic inductor 16*b*.

Here, at the used frequency f4 of the SPST switch of the present embodiment, it is assumed that the relationship holds of f4=1/2π√(inductance of parasitic inductor 16*a*)×(capacitance of capacitor 27*a*)=1/2π√(inductance of parasitic inductor 16*b*)×(capacitance of capacitor 27*b*), that is, the capacitor 27*a* that will cause series resonance with the parasitic inductor 16*a* is connected to electrically cancel out the parasitic inductor 16*a* that hinders the parallel resonance of the OFF capacitance 15*a* and inductor 13*a*, and the capacitor 27*b* that will cause series resonance with the parasitic inductor 16*b* is connected to electrically cancel out the parasitic inductor 16*b* that hinders the parallel resonance of the OFF capacitance 15*b* and inductor 13*b*. In addition, at the used frequency f4 of the SPST switch, it is assumed that the relationship holds of f4=1/√(capacitance of OFF capacitance 15*a*)×(inductance of inductor 13*a*)=1/π√(capacitance of OFF capacitance 15*b*)×(inductance of inductor 13*b*), that is, the inductor 13*a* that will cause parallel resonance with the OFF capacitance 15*a* is connected, and the inductor 13*b* that will cause parallel resonance with the OFF capacitance 15*b* is connected. In this case, the impedance of the output terminal 11*b* seen from the input terminal 11*a* becomes high. Thus, the high frequency signal input through the input terminal 11*a* is not fed to the output terminal 11*b*, and the isolation of the high frequency signal from the input terminal 11*a* to the output terminal 11*b* is not reduced.

Figure 18:
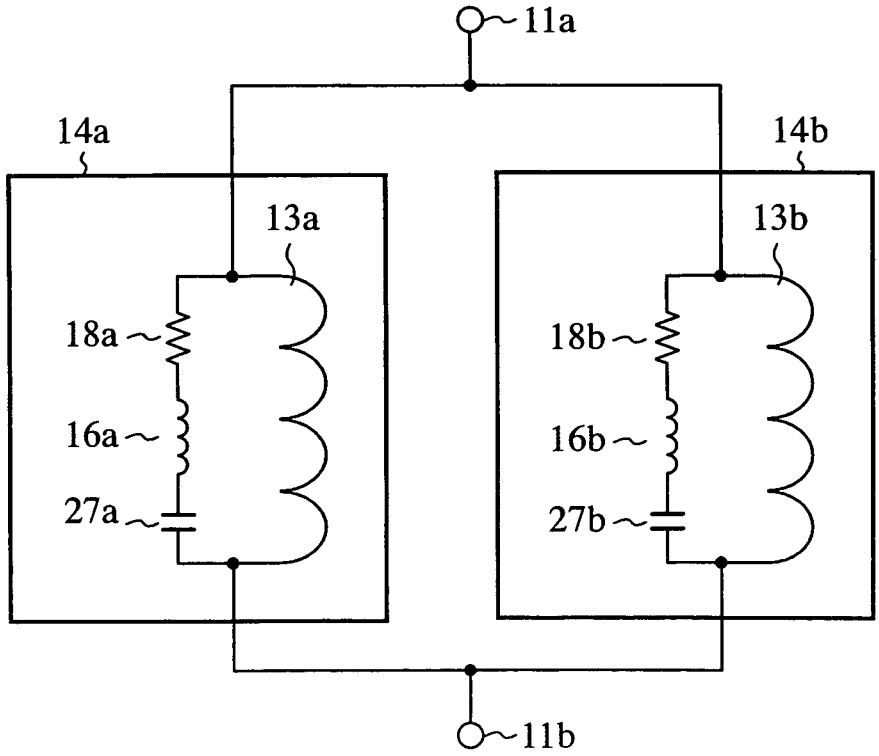
FIG. 18 is an equivalent circuit diagram when the field-effect transistors in FIG. 16 are brought into the ON state.

FIG. 18 is an equivalent circuit diagram when the FET 12*a* and FET 12*b* in FIG. 16 are brought into the ON state. As shown in FIG. 18, when the FET 12*a* is brought into the ON state, a state arises in which the ON resistance 18*a* and parasitic inductor 16*a* are connected in series, and when the FET 12*b* is brought into the ON state, a state arises in which the ON resistance 18*b* and parasitic inductor 16*b* are connected in series.

Here, at the used frequency f4 of the SPST switch, it is assumed that the relationship holds of f4=1/2π√(inductance of parasitic inductor 16*a*)×(capacitance of capacitor 27*a*)=1/2π√(inductance of parasitic inductor 16*b*)×(capacitance of capacitor 27*b*), that is, the capacitor 27*a* that will cause series resonance with the parasitic inductor 16*a* is connected, and the capacitor 27*b* that will cause series resonance with the parasitic inductor 16*b* is connected. In this case, the impedance of the output terminal 11*b* seen from the input terminal 11*a* becomes low. Thus, the high frequency signal input through the input terminal 11*a* is fed to the output terminal 11*b*, and the propagation loss of the high frequency signal can be reduced.

Here, the inductance of the parasitic inductors 16*a* and 16*b* in the OFF state of the FETs 12*a* and 12*b* shown in FIG. 17 is equal to the inductance of the parasitic inductors 16*a* and 16*b* in the ON state of the FETs 12*a* and 12*b* shown in FIG. 18. In addition, the values of the capacitances of the capacitors 27*a* and 27*b* that will cause the series resonance with the parasitic inductors 16*a* and 16*b* in the OFF state and in the ON state of the FETs 12*a* and 12*b* are equal.

In the present embodiment 5, although the high frequency signal is controlled in such a manner that it is input through the input terminal 11*a* and is fed to the output terminal 11*b*, this is not essential. A configuration is also possible in which the high frequency signal is controlled in such a manner that it is input through the output terminal 11*b* and is fed to the input terminal 11*a*.

In addition, although the two second FET switches 14*a* and 14*b* are connected in parallel in the present embodiment 5, two or more second FET switches can be connected in parallel.

As described above, even when the gate width of the FETs 12*a* and 12*b* is increased to provide the SPST switch with the high withstanding power, the present embodiment 5 offers an advantage of being able to reduce the propagation loss of the high frequency signal from the input terminal 11*a* to the output terminal 11*b* without reducing the isolation of the high frequency signal from the input terminal 11*a* to the output terminal 11*b* by connecting the capacitor 27*a* that will cause the series resonance with the parasitic inductor 16*a* at the used frequency f4 of the SPST switch, by connecting the capacitor 27*b* that will cause the series resonance with the parasitic inductor 16*b*, by connecting the inductor 13*a* that will cause the parallel resonance with the OFF capacitance 15*a*, and by connecting the inductor 13*b* that will cause the parallel resonance with the OFF capacitance 15*b*.

Embodiment 6

Figure 19:
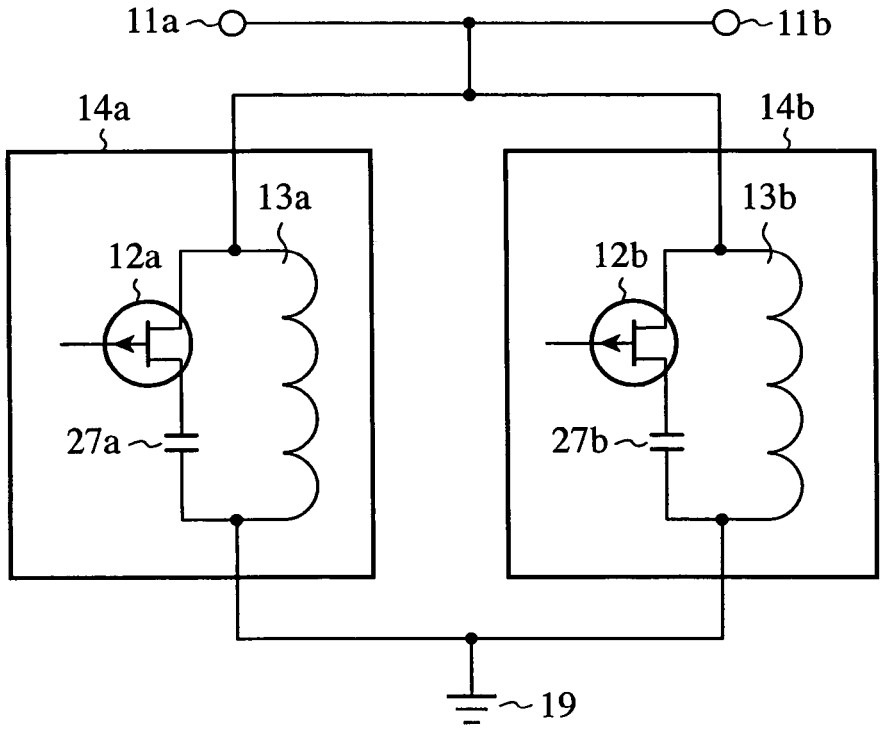
FIG. 19 is a circuit diagram showing a configuration of an SPST switch of an embodiment 6 in accordance with the present invention.

FIG. 19 is a circuit diagram showing a configuration of an SPST switch of an embodiment 6 in accordance with the present invention. The SPST switch as shown in FIG. 19, which employs parallel connection of the two second FET switches 14 of the embodiment 4 as shown in FIG. 13, has an input terminal 11*a*, output terminal 11*b*, FET 12*a*, FET 12*b*, inductor 13*a*, inductor 13*b*, capacitor 27*a*, capacitor 27*b*, and ground 19. The second FET switch 14*a*, in which the serial connection of the FET 12*a* and capacitor 27*a* is connected in parallel with the inductor 13*a*, and the second FET switch 14*b*, in which the serial connection of the FET 12*b* and capacitor 27*b* is connected in parallel with the inductor 13*b*, have their first terminals connected to the input terminal 11*a* and output terminal 11*b*, and their second terminals connected to the ground 19.

Next the operation will be described.

In FIG. 19, the FET 2*a* and FET 2*b* operate as switches for switching between the ON state and OFF state by the voltages applied to the gates.

Figure 20:
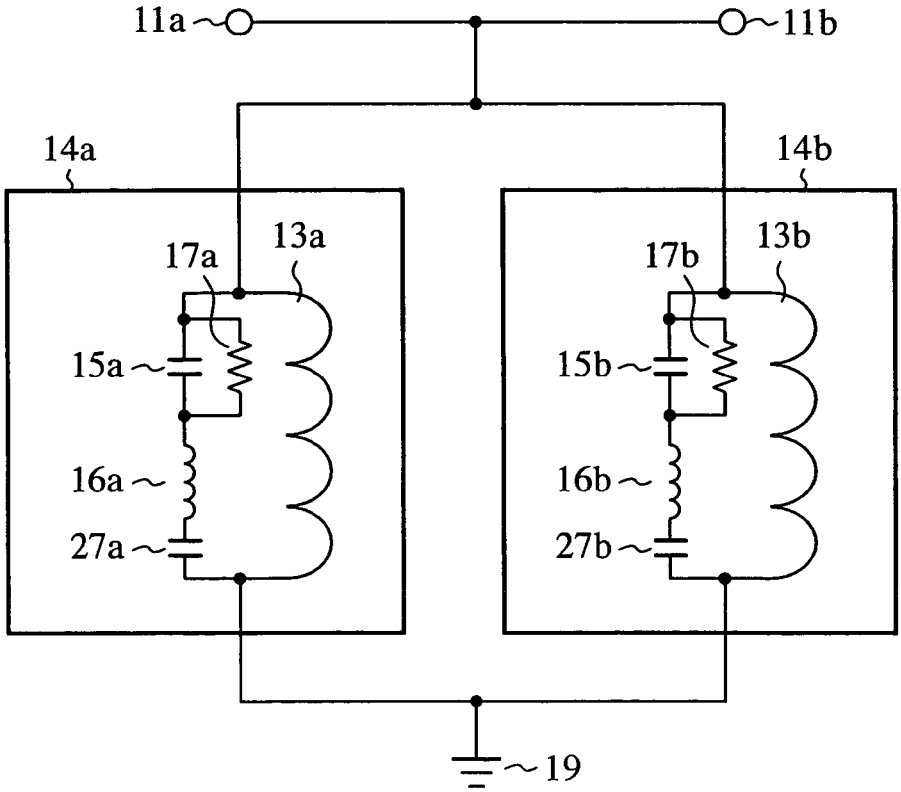
FIG. 20 is an equivalent circuit diagram when field-effect transistors in FIG. 19 are brought into the OFF state.

FIG. 20 is an equivalent circuit diagram when the FET 12*a* and FET 12*b* in FIG. 19 are brought into the OFF state. As shown in FIG. 20, when the FET 12*a* is brought into the OFF state, a state arises in which the OFF capacitance 15*a* and OFF resistance 17*a* which are connected in parallel are connected in series with the parasitic inductor 16*a*, and when the FET 12*b* is brought into the OFF state, a state arises in which the OFF capacitance 15*b* and OFF resistance 17*b* which are connected in parallel are connected in series with the parasitic inductor 16*b*.

Here, at the used frequency f4 of the SPST switch of the present embodiment, it is assumed that the relationship holds of f4=1/2π√(inductance of parasitic inductor 16*a*)×(capacitance of capacitor 27*a*)=1/2π√(inductance of parasitic inductor 16*b*)×(capacitance of capacitor 27*b*), that is, the capacitor 27*a* that will cause series resonance with the parasitic inductor 16*a* is connected to electrically cancel out the parasitic inductor 16*a* that hinders the parallel resonance of the OFF capacitance 15*a* and inductor 13*a*, and the capacitor 27*b* that will cause series resonance with the parasitic inductor 16*b* is connected to electrically cancel out the parasitic inductor 16*b* that hinders the parallel resonance of the OFF capacitance 15*b* and inductor 13*b*. In addition, at the used frequency f4 of the SPST switch, it is assumed that the relationship holds of f4=1/√(capacitance of OFF capacitance 15*a*)×(inductance of inductor 13*a*)=1/√(capacitance of OFF capacitance 15*b*)×(inductance of inductor 13*b*), that is, the inductor 13*a* that will cause parallel resonance with the OFF capacitance 15*a* is connected, and the inductor 13*b* that will cause parallel resonance with the OFF capacitance 15*b* is connected. In this case, the impedance of the ground 19 seen from the input terminal 11*a* becomes high. Thus, the high frequency signal input through the input terminal 11*a* is fed to the output terminal 11*b*, and the propagation loss of the high frequency signal can be reduced.

Figure 21:
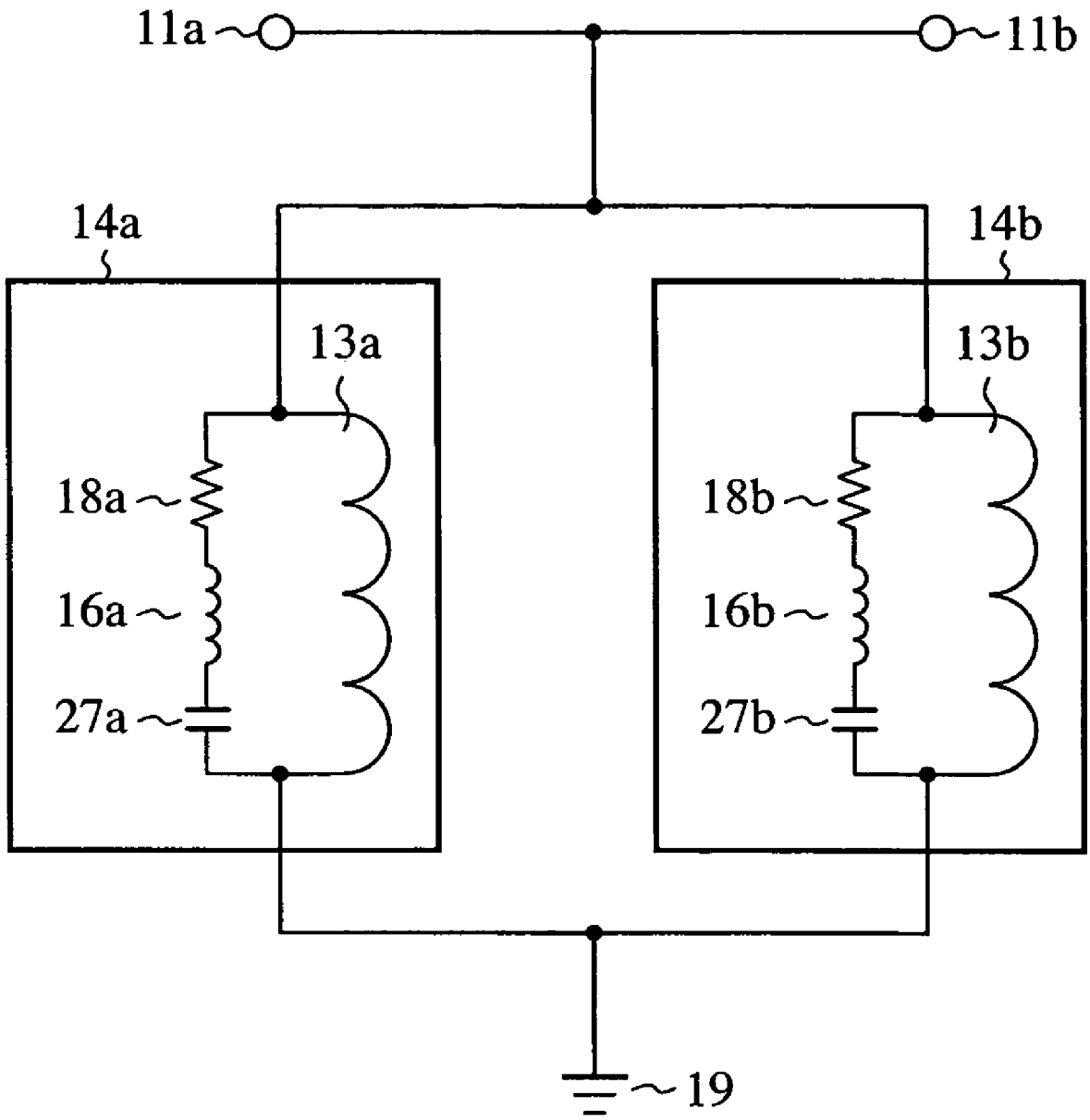
FIG. 21 is an equivalent circuit diagram when the field-effect transistors in FIG. 19 are brought into the ON state.

FIG. 21 is an equivalent circuit diagram when the FET 12*a* and FET 12*b* in FIG. 19 are brought into the ON state. As shown in FIG. 21, when the FET 12*a* is brought into the ON state, a state arises in which the ON resistance 18*a* and parasitic inductor 16*a* are connected in series, and when the FET 12*b* is brought into the ON state, a state arises in which the ON resistance 18*b* and parasitic inductor 16*b* are connected in series.

Here, at the used frequency f4 of the SPST switch, it is assumed that the relationship holds of f4=1/2π√(inductance of parasitic inductor 16*a*)×(capacitance of capacitor 27*a*)=1/2π√(inductance of parasitic inductor 16*b*)×(capacitance of capacitor 27*b*), that is, the capacitor 27*a* that will cause series resonance with the parasitic inductor 16*a* is connected, and the capacitor 27*b* that will cause series resonance with the parasitic inductor 16*b* is connected. In this case, the impedance of the output terminal 11*b* seen from the input terminal 11*a* becomes low. Thus, the high frequency signal input through the input terminal 11*a* is not fed to the output terminal 11*b*, and the isolation of the high frequency signal from the input terminal 11*a* to the output terminal 11*b* is not reduced.

Here, the inductance of the parasitic inductors 16*a* and 16*b* in the OFF state of the FETs 12*a* and 12*b* shown in FIG. 20 is equal to the inductance of the parasitic inductors 16*a* and 16*b* in the ON state of the FETs 12*a* and 12*b* shown in FIG. 21. In addition, the values of the capacitances of the capacitors 27*a* and 27*b* that will cause the series resonance with the parasitic inductors 16*a* and 16*b* in the OFF state and in the ON state of the FETs 12*a* and 12*b* are equal.

In the present embodiment 6, although the high frequency signal is controlled in such a manner that it is input through the input terminal 11*a* and is fed to the output terminal 11*b*, this is not essential. A configuration is also possible in which the high frequency signal is controlled in such a manner that it is input through the output terminal 11*b* and is fed to the input terminal 11*a*.

In addition, although the two second FET switches 14*a* and 14*b* are connected in parallel in the present embodiment 6, two or more second FET switches can be connected in parallel.

As described above, even when the gate width of the FETs 12*a* and 12*b* is increased to provide the SPST switch with the high withstanding power, the present embodiment 6 offers an advantage of being able to reduce the propagation loss of the high frequency signal from the input terminal 11*a* to the output terminal 11*b*, and to prevent the reduction in the isolation of the high frequency signal from the input terminal 11*a* to the output terminal 11*b* by connecting the capacitor 27*a* that will cause the series resonance with the parasitic inductor 16*a* at the used frequency f4 of the SPST switch, by connecting the capacitor 27*b* that will cause the series resonance with the parasitic inductor 16*b*, by connecting the inductor 13*a* that will cause the parallel resonance with the OFF capacitance 15*a*, and by connecting the inductor 13*b* that will cause the parallel resonance with the OFF capacitance 15*b*.

Embodiment 7

Figure 22:
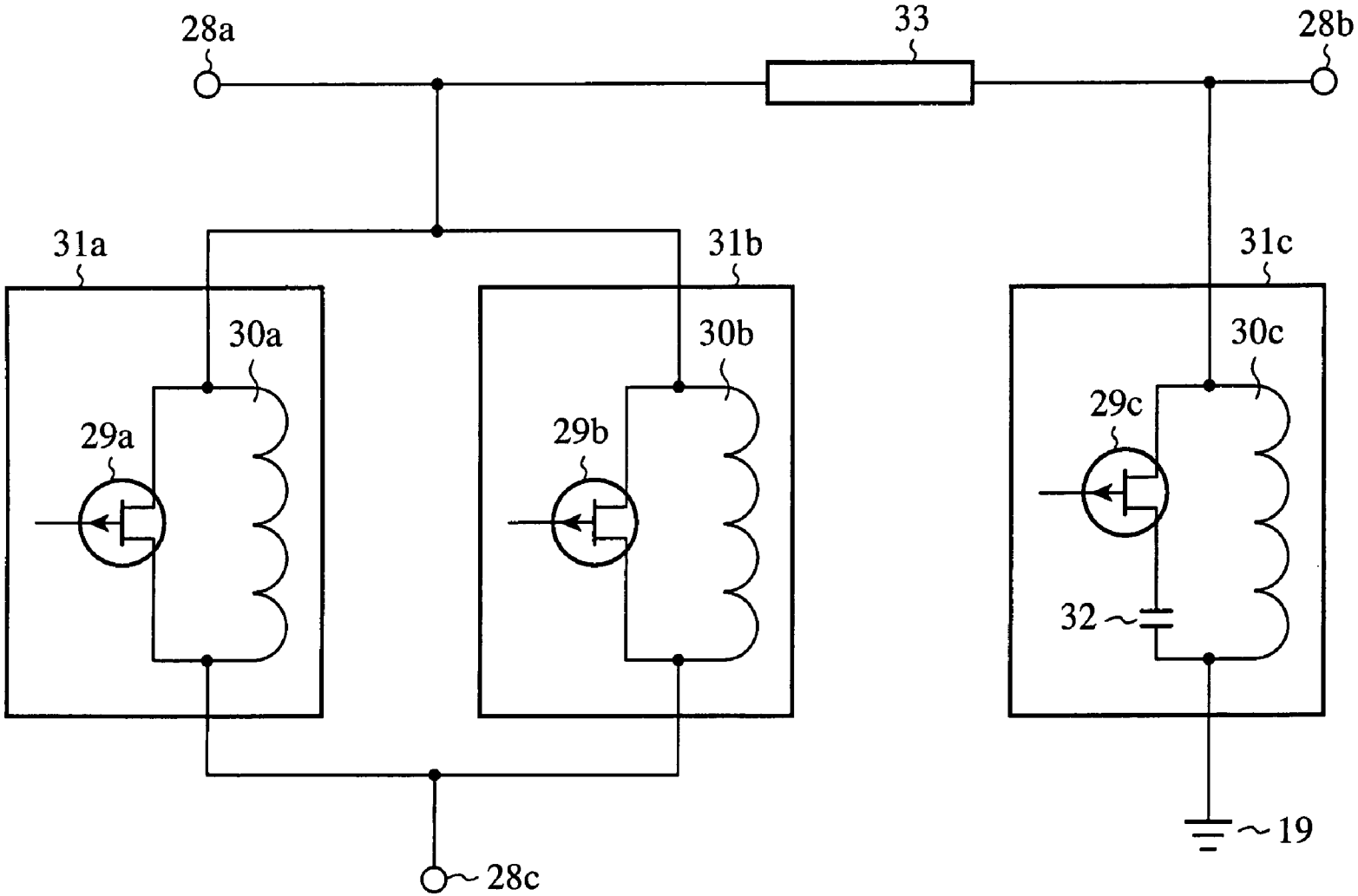
FIG. 22 is a circuit diagram showing a configuration of an SPDT switch of an embodiment 7 in accordance with the present invention.

FIG. 22 is a circuit diagram showing a configuration of an SPDT switch of an embodiment 7 in accordance with the present invention. The SPDT switch as shown in FIG. 22 includes an input terminal 28*a*, output terminal 28*b*, output terminal 28*c*, FET 29*a*, FET 29*b*, FET 29*c*, inductor 30*a*, inductor 30*b*, inductor 30*c*, capacitor 32, line 33 and ground 19. A first FET switch 31*a*, in which the FET 29*a* and inductor 30*a* are connected in parallel, and a first FET switch 31*b*, in which the FET 29*b* and inductor 30*b* are connected in parallel, have their first terminals connected to the input terminal 28*a*, and their second terminals connected to the output terminal 28*c*. The line 33 has its first terminal connected to the input terminal 28*a*, and its second terminal connected to the output terminal 28*b*. A second FET switch 31*c*, in which a series connection of the FET 29*c* and capacitor 32 is connected in parallel with the inductor 30*c*, has its first terminal connected to the output terminal 28*b*, and its second terminal connected to the ground 19. Here, the line length of the line 33 is assumed to be 1/4 wavelength at a used frequency f5.

In the present embodiment 7, the first FET switches 14*a* and 14*b* as shown in FIG. 4 of the embodiment 1 are used as the first FET switches 31*a* and 31*b*, and the second FET switch 14 as shown in FIG. 13 of the embodiment 4 is used as the second FET switch 31*c*.

Next the operation will be described.

In FIG. 22, the FET 29*a*, FET 29*b* and FET 29*c* operate as switches for switching between the ON state and OFF state by the voltages applied to the gates.

Figure 23:
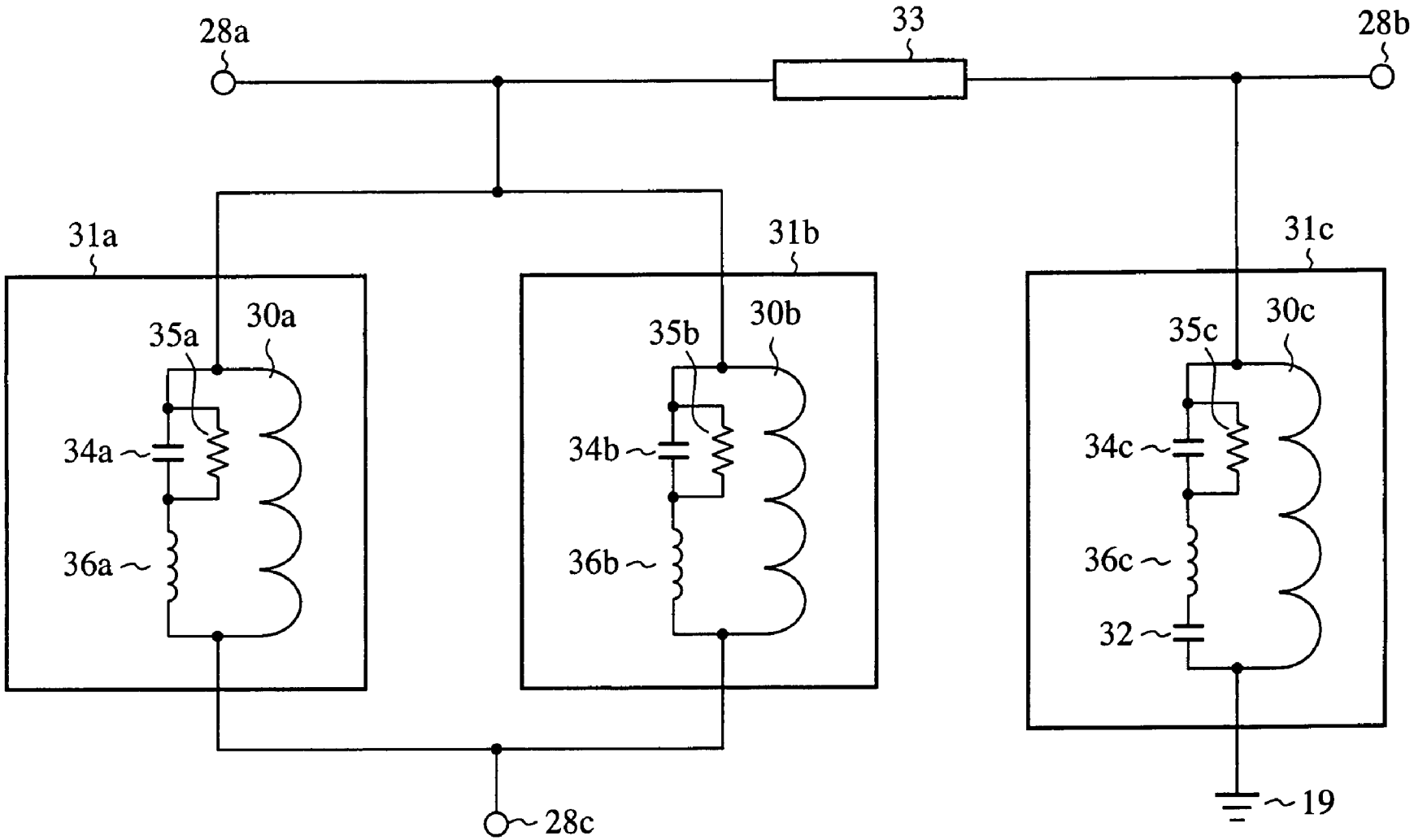
FIG. 23 is an equivalent circuit diagram when field-effect transistors in FIG. 22 are brought into the OFF state.

FIG. 23 is an equivalent circuit diagram when the FET 29*a*, FET 29*b* and FET 29*c* in FIG. 22 are brought into the OFF state. As shown in FIG. 23, when the FET 29*a* is brought into the OFF state, a state arises in which the OFF capacitance 34*a* and OFF resistance 35*a* which are connected in parallel are connected in series with the parasitic inductor 36*a*, when the FET 29*b* is brought into the OFF state, a state arises in which the OFF capacitance 34*b* and OFF resistance 35*b* which are connected in parallel are connected in series with the parasitic inductor 36*b*, and when the FET 29*c* is brought into the OFF state, a state arises in which the OFF capacitance 34*c* and OFF resistance 35*c* which are connected in parallel are connected in series with the parasitic inductor 36*c*.

It is assumed here that at the used frequency f5 of the SPDT switch of the present embodiment, the relationships hold of f5=1/2π√(inductance of parasitic inductor 36*c*)×(capacitance of capacitor 32), and f5=1/2π√(capacitance of OFF capacitance 34*c*)×(inductance of inductor 30*c*).

Connecting the two FETs 29*a* and 29*b* in parallel can halve their individual gate width to achieve the same withstanding power. Halving the individual gate width can make the reactance components of the parasitic inductors 36*a* and 36*b* of the FETs 29*a* and FET 29*b* small enough as compared with the reactance components of the OFF capacitances 34*a* and 34*b* at the frequency f5 used by the SPDT switch, and make the OFF resistances 35*a* and 35*b* large enough.

In addition, at the used frequency f5 of the SPDT switch, when the relationship holds of f5=1/√(capacitance of OFF capacitance 34*a*)×(inductance of inductor 30*a*)=1/√(capacitance of OFF capacitance 34*b*)×(inductance of inductor 30*b*), the impedance of the output terminal 28*b* seen from the input terminal 28*a* becomes low, and the impedance of the output terminal 28*c* seen from the input terminal 28*a* becomes high. In this case, the high frequency signal input through the input terminal 28*a* is fed to the output terminal 28*b*, and the propagation loss of the high frequency signal can be reduced. In contrast, the high frequency signal input through the input terminal 28*a* is not fed to the output terminal 28*c*, and the isolation of the high frequency signal from the input terminal 28*a* to the output terminal 28C is not reduced.

Figure 24:
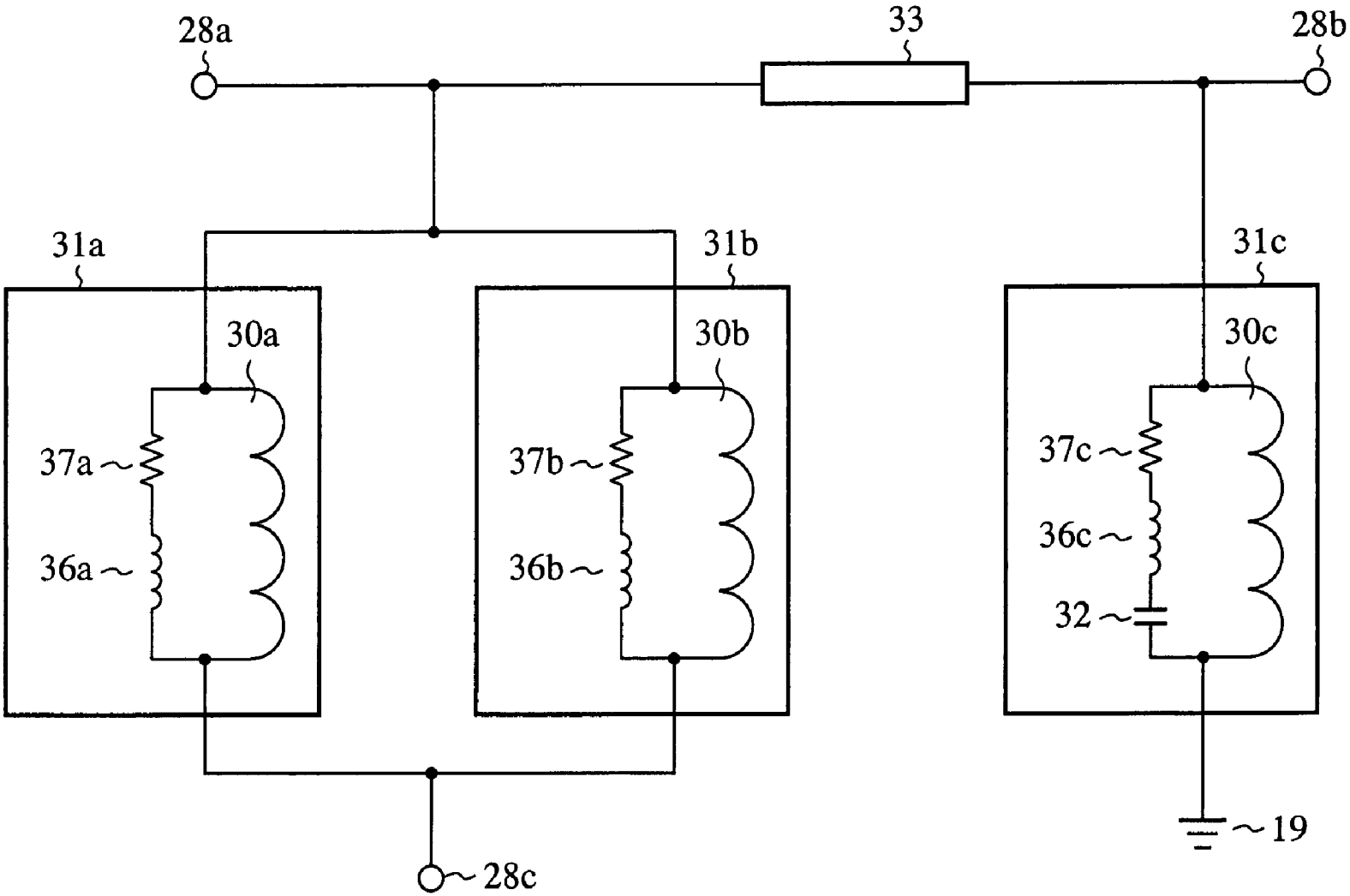
FIG. 24 is an equivalent circuit diagram when the field-effect transistors in FIG. 22 are brought into the ON state.

FIG. 24 is an equivalent circuit diagram when the FET 29*a*, FET 29*b* and FET 29*c* in FIG. 22 are brought into the ON state. As shown in FIG. 24, when the FET 29*a* is brought into the ON state, a state arises in which the ON resistance 37*a* and parasitic inductor 36*a* are connected in series, when the FET 29*b* is brought into the ON state, the ON resistance 37*b* and parasitic inductor 36*b* are connected in series, and when the FET 29*c* is brought into the ON state, the ON resistance 37*c* and parasitic inductor 36*c* are connected in series.

It is assume here that at the used frequency f5 of the SPDT switch, the relationship holds of f5=1/2π√(inductance of parasitic inductor 36*c*)×(capacitance of capacitor 32). Since the line length of the line 33 is 1/4 wavelength at the used frequency f5, the impedance of the output terminal 28*b* seen from the input terminal 28*a* becomes high. In addition, since the first FET switches 31*a* and 31*b* are connected in parallel, the impedance of the output terminal 28*c* seen from the input terminal 28*a* becomes low. In this case, the high frequency signal input through the input terminal 28*a* is fed to the output terminal 28*c*, and the propagation loss of the high frequency signal can be reduced. At the same time, the high frequency signal input through the input terminal 28*a* is not fed to the output terminal 28*b*, and the isolation of the high frequency signal from the input terminal 28*a* to the output terminal 28*b* is not reduced.

Although the SPDT switch in the present embodiment 7 employs the first FET switches 31*a* and 31*b* and second FET switch 31*c*, the SPDT switch can be constructed from the first FET switches shown in the embodiments 1 and 2, or from the second FET switches shown in the embodiments 3, 4, 5, and 6, or from an appropriate combination of the first FET switches and second FET switches as shown in the embodiments 1-6.

As described above, the present embodiment 7 enables the SPDT switch to be constructed by combining the SPST switch from the embodiment 1 to the embodiment 6, thereby offering an advantage of being able to reduce the propagation loss of the high frequency signal from the input terminal 28*a* to the output terminal 28*b* or 28*c*, and to prevent the reduction in the isolation of the high frequency signal from the input terminal 28*a* to the output terminal 28*b* or 28*c*.

Embodiment 8

Figure 25:
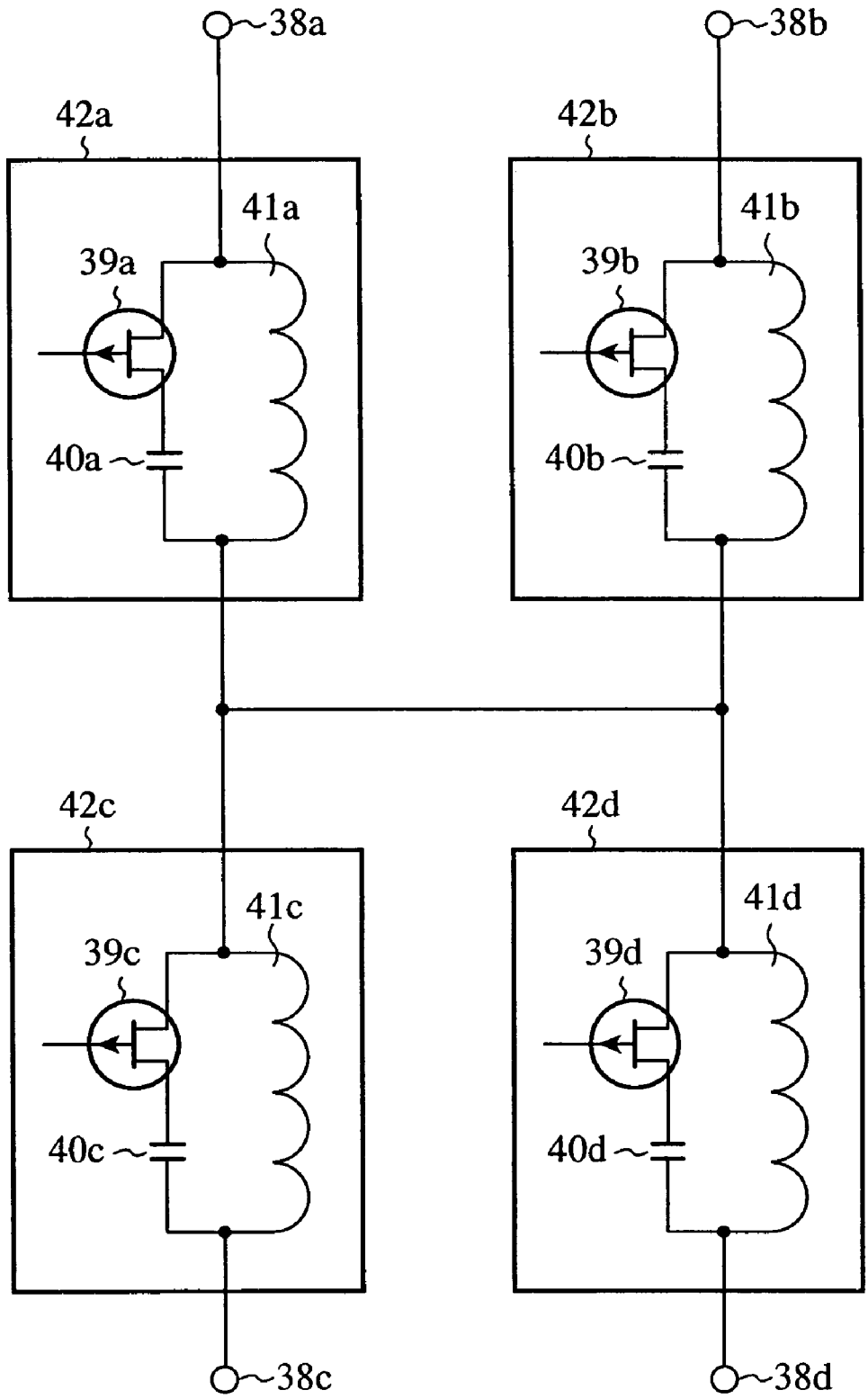
FIG. 25 is a circuit diagram showing a configuration of an MPMT switch of an embodiment 8 in accordance with the present invention.

FIG. 25 is a circuit diagram showing a configuration of an MPMT switch of an embodiment 8 in accordance with the present invention. Although only the SPDT switch is described in connection with FIG. 22 of the foregoing embodiment 7, combining the SPST switches from the foregoing embodiment 1 to embodiment 6 can construct an MPMT switch as shown in FIG. 25, for example.

The MPMT switch as shown in FIG. 25 includes input terminals or output terminals 38*a*, 38*b*, 38*c* and 38*d*; FETs 39*a*, 39*b*, 39*c* and 39*d*; capacitors 40*a*, 40*b*, 40*c* and 40*d*; and inductors 41*a*, 41*b*, 41*c* and 41*d*. The FET 39*a*, capacitor 40*a* and inductor 41*a* constitute a second FET switch 42*a*; the FET 39*b*, capacitor 40*b* and inductor 41*b* constitute a second FET switch 42*b*; the FET 39*c*, capacitor 40*c* and inductor 41*c* constitute a second FET switch 42*c*; and the FET 39*d*, capacitor 40*d* and inductor 41*d* constitute a second FET switch 42*d*.

The second FET switches 42*a*, 42*b*, 42*c* and 42*d* have their first terminals connected to the input terminals or output terminals 38*a*, 38*b*, 38*c* and 38*d*, respectively, and their second terminals connected with each other.

Next the operation will be described.

FIG. 26 is a table illustrating the operation of the MPMT switch of FIG. 25. Controlling the turning on and off of the individual FETs 39*a*, 39*b*, 39*c* and 39*d* enables the high frequency signal input through a designate input terminal to be fed to a designated output terminal.

Although the MPMT switch in the present embodiment 8 employs the second FET switches 42*a*, 42*b*, 42*c* and 42*d*, the MPMT switch can be constructed from the first FET switches as shown in the embodiment 1 or 2, or from the second FET switches as shown in the embodiment 3, 4, 5 or 6, or from an appropriate combination of the first FET switches and second FET switches as shown in the embodiments 1-6.

As described above, the present embodiment 8 can configure the MPMT switch by combining the SPST switches shown from the embodiment 1 to embodiment 6, thereby offering an advantage of being able to reduce the propagation loss of the high frequency signal from the input terminal to the output terminal, and to prevent the reduction in the isolation of the high frequency signal from the input terminal to the output terminal.

INDUSTRIAL APPLICABILITY

As described above, the SPST switch, SPDT switch and MPMT switch in accordance with the present invention can reduce the propagation loss of the high frequency signal, and prevent the reduction of the isolation of the high frequency signal.

What is claimed is:

1. An SPST (single-pole single-throw) switch for controlling propagation of a high frequency signal between an input terminal and an output terminal, said SPST switch comprising:

a plurality of field-effect transistor (FET) switches, each of said plurality of FET switches is connected in parallel with each other, and each of said plurality of FET switches having a field-effect transistor whose drain and source are directly connected in parallel with an inductor, wherein the input of said plurality of FET switches is directly connected to the input terminal of said SPST switch and the output of said plurality of FET switches is directly connected to the output terminal of said SPST switch;

each of said field-effect transistors has an ON state and an OFF state changed by a voltage applied to a gate of each of said field-effect transistors, and each of said field-effect transistors has an OFF capacitance that causes parallel resonance with said inductor connected at a frequency of the high frequency signal.

2. An SPST (single-pole single-throw) switch for controlling propagation of a high frequency signal between an input terminal and an output terminal, said SPST switch comprising:

a field-effect transistor (FET) switch constructed by directly connecting an inductor in parallel with a series circuit, the series circuit consisting of a capacitor connected in series with a drain or source of FET, wherein if the drain of the FET is directly connected with the capacitor, then the source of the FET is connected with the input terminal of said SPST switch and if the source of the FET is directly connected with the capacitor, then the drain of the FET is connected with the input terminal of said SPST switch; and wherein said FET has an ON state and an OFF state changed by a voltage applied to a gate of said FET, and said FET has a parasitic inductor and said capacitor causing series resonance with parasitic inductance of the FET, and the inductor causing parallel resonance with parasitic capacitance of the FET and the capacitor.

3. The SPST switch according to claim 2, wherein the input of said FET switch is directly connected to the input terminal of said SPST switch and the output of said FET switch is directly connected to the output terminal of said SPST switch.

4. The SPST switch according to claim 3, further comprising a plurality of FET switches, each of said plurality of FET switches is connected in parallel with each other between the input terminal and the output terminal.

5. The SPST switch according to claim 2, wherein the input of said FET switch is directly connected to the input terminal or the output terminal of said SPST; and the output of said FET switch is directly connected to ground.

6. The SPST switch according to claim 5, further comprising a plurality of FET switches, each of said plurality of FET switches is connected in parallel with each other, wherein the input of said plurality of parallel FET switches is directly connected to the input terminal of said SPST and the output of said plurality of parallel FET switches is directly connected to ground.

7. An SPDT (single-pole double-throw) switch for controlling propagation of a high frequency signal between an input terminal and two output terminals, said SPDT switch employing: a plurality of field-effect transistor (FET) switches, each of said plurality of FET switches is connected in parallel with each other, and each of said plurality of FET switches having a field-effect transistor whose drain and source are directly connected in parallel with an inductor; and wherein the input of said plurality of parallel FET switches is directly connected to the input terminal of said SPDT switch and the output of said plurality of parallel FET switches is directly connected to a first output terminal of said SPDT switch a single field-effect transistor (FET) switch having an inductor directly connected in parallel with a series circuit, the series circuit consisting of a capacitor connected in series with a drain or source of a field-effect transistor: and wherein the input of said single FET switch is directly connected to a second output terminal of said SPDT switch and the output of said single FET switch is directly connected to ground.

8. An MPMT (multiple-pole multiple throw) switch for controlling propagation of a high frequency signal between a plurality of input terminals and a plurality of output terminals, said MPMT switch employing:

a plurality of field-effect transistor (FET) switches connected in parallel, each of said plurality of parallel FET switches having a field-effect transistor whose drain and source are directly connected in parallel with an inductor; and wherein the input of said plurality of parallel FET switches is directly connected to an input terminal of said MPMT switch and the output of said plurality of parallel FET switches is directly connected to an output terminal of said MPMT switch.

9. An MPMT (multiple-pole multiple throw) switch for controlling propagation of a high frequency signal between a plurality of input terminals and a plurality of output terminals, said MPMT switch employing:

a plurality of field-effect transistor (FET) switches, each of said FET switches having an inductor directly connected in parallel with a series circuit, the series circuit consisting of a capacitor connected in series with a drain or source of a field-effect transistor; and wherein said FET switches having their first terminals connected to corresponding input terminal or output terminal of the said MPMT switch and wherein said FET switches having their second terminals connected with each other.

* * * * *